US005561931A

United States Patent [19]

Duenkel

[11] Patent Number: 5,561,931

[45] Date of Patent: Oct. 8, 1996

[54] PUBLICITY DISPLAY

[75] Inventor: Andreas Duenkel, Biberach, Germany

[73] Assignee: Dannhaeuser GmbH, Schemmerhofen, Germany

[21] Appl. No.: 302,827

[22] PCT Filed: Mar. 26, 1993

[86] PCT No.: PCT/DE93/00302

§ 371 Date: Sep. 23, 1994

§ 102(e) Date: Sep. 23, 1994

[87] PCT Pub. No.: WO93/19451

PCT Pub. Date: Sep. 30, 1993

[30] Foreign Application Priority Data

Mar. 26, 1992 [DE] Germany ..... 42 09 810.6

[51] Int. Cl.[6] ..... G09F 15/00

[52] U.S. Cl. ..... 40/606; 40/607; 40/603

[58] Field of Search ..... 40/606, 607, 612, 40/603, 604; 52/23, 152, 149

[56] References Cited

U.S. PATENT DOCUMENTS

| | | | |
|---|---|---|---|
| 1,327,427 | 1/1920 | Foster | 40/607 |
| 2,893,147 | 7/1959 | Mollet, III | 40/607 X |
| 3,167,874 | 2/1965 | Pogue | 40/606 X |
| 3,273,273 | 9/1966 | McLarty | 40/607 X |
| 3,517,905 | 6/1970 | Nestegard | 40/606 X |
| 4,202,121 | 5/1980 | Maris et al. | 40/606 X |
| 4,357,772 | 11/1982 | Amick et al. | 40/606 X |

FOREIGN PATENT DOCUMENTS

| | | | |
|---|---|---|---|
| 557837 | 8/1932 | Germany | 40/606 |
| 553520 | 3/1993 | Japan | 40/606 |
| 121230 | of 1948 | Sweden | 40/607 |
| 12050 | of 1895 | United Kingdom | 40/606 |

*Primary Examiner*—Peter M. Cuomo
*Assistant Examiner*—James O. Hansen
*Attorney, Agent, or Firm*—Spencer & Frank

[57] ABSTRACT

A publicity display includes a central tubular mast and a plurality of transversal tubes each having one end fixed to the central tubular mast and a free end projecting radially from the central tubular mast. The upper ends of a pair of vertical support tubes is attached to the free end of each transversal tube. The lower ends of each pair of tubes are connected to tensioning cables which have their other end connected to a ground anchor. A plurality of canvasses each for having an advertisement thereon are provided, with each canvas being fixed on two of the vertical supports which are spaced apart from one another and fixed to adjacent transversal tubes to form a plurality of publicity supports each having a triangular plan view.

26 Claims, 19 Drawing Sheets

PUBLICITY DISPLAY

BACKGROUND OF THE INVENTION

The invention relates to a publicity display having a plurality of publicity supports, which are polygonal and in particular triangular in plan view and disposed on a central tubular mast.

From German Utility Model DE 86 24 053 U1, a triangular publicity support is already known that comprises three rectangular publicity support frames, one segmented tube arch and one publicity support mast, with a wedge connection mounted on the upper end. The publicity support frames are combined to make a closed equilateral triangle, suspended vertically, which is secured to a centrally disposed publicity support mast. The individual publicity support frames each have two guide grooves for receiving one holder for a poster and a protective pane in front of it. On the lower end, the publicity support mast is provided with a flange on which it stands, which has four bores for securing it to the ground. A triangular publicity support of this kind not only requires considerable expenditure in terms of production but also complicated assembly work to construct it. Moreover, the danger exists that the protective panes of the poster holders are easily destroyed.

From German Utility Model 77 13 932 U1, an advertising device is also known that has a hollow body, disposed on a support column, for receiving publicity displays; transparent double panes, which between them have an intermediate space intended to receive the publicity supports, are disposed on the jacket face of the hollow body, and the hollow body includes a frame construction into which the double panes are inserted in watertight fashion. The base of the support column is embedded in a concrete receptacle. This advertising device is also relatively complicated in terms of its construction. Moreover, it is complicated and time-consuming to change the publicity supports on the hollow body. Moreover, if its structural height is great, it is not adequately protected against tipping over.

SUMMARY OF THE INVENTION

The object of the invention is to create a publicity display of the type referred to at the outset, which has adequate stability even when deployed out in the open, which assures easy replacement of the publicity displays, and which is easy to assemble and disassemble.

According to the invention, this object is attained in that each publicity support comprises a flexible canvas provided with an advertisement and is fixed on two vertical support tubes, spaced apart suitably from one another and the support tubes adjacent to one another are joined on their upper end, via a transversal tube, to the tubular mast and on their lower end, via a tensioning cable, to a ground anchor.

By bracing the publicity supports at the corners, high stability of the publicity displays are attained, which is especially advantageous when the publicity display is set up in the open air, exposed to strong winds. Since the publicity supports comprises canvases that carry the advertisement, no separate frame constructions are required for their retention. The canvaslike publicity supports can easily be changed by loosening their fastening to the support tubes. Moreover, the provisions according to the invention assure rapid setup and dismantling of the publicity display.

In an advantageous feature of the invention, to facilitate transport, the tubular mast is composed of a plurality of detachably joined-together individual sections.

In another advantageous feature of the invention, to assure reliable stability of the tubular mast, the end toward the ground of the tubular mast is provided with a base that has three arms at an angle of 120° from one another.

In a further feature of the invention, to allow the base to be collapsed into a small unit for transport, the base includes a bottom plate and a top plate, between which the arms of the base are supported pivotably about screw bolts that protrude past the top plate. Suitably, the protruding screw bolts of the base are each joined to a support pan that receives the tubular mast, via a cardan joint fixed to the associated screw bolt between two nuts. As a result, the tubular mast can always be erected plumb, by means of a suitable adjustment of the inclination of the support tube. Preferably, each cardan joint comprises a fork, supported rotationally movably in the support pan, and a bearing eye supported rotationally movably in the fork, and the fork of a cardan joint is received in the support pan in such a way as to be longitudinally displaceable counter to the force of a spring.

In a further feature of the invention, for carrying away rainwater that gets into the interior of the tubular mast, a water drain opening is let into the support pan centrally with respect to the lower individual section of the tubular mast.

Furthermore, it is preferably provided that each arm of the base, on its end, has a flattened region with a through bore for receiving a ground nail. This reliably precludes relative motion between the base and the ground.

For the sake of a simple attachment of the transversal tubes to the tubular mast, in a further advantageous feature of the invention, the transversal tubes that carry the support tubes are secured to the upper individual section of the tubular mast at the desired level via a pipe clamp. Preferably, the transversal tubes are each joined to the pipe clamp via a joint and are retained in their horizontal position each by a cable secured to the free end of the transversal tube and to the top end of the tubular mast. As a result, by suitable swiveling of the transversal tubes, the upper individual segment of the tubular mast and the transversal tubes are combined to make a compact unit for transport. To increase the stability of the transversal tubes on their end toward the tubular mast, in a further feature of the subject of the invention, in the region of the joint inside each transversal tube, there is an insert piece with a through bore for the pivot pin.

In a further advantageous feature of the invention, to enable mounting a flagpole with a flag on the tubular mast, the upper end of the tubular mast carries an attachment piece with a centrally disposed tube closed by a bottom plate, into which tube the lower end of a flagpole is inserted. Suitably, the attachment piece includes a tube section resting on the face end of the tubular mast, which section is joined to the tube receiving the flagpole via three pairs of straps, which are at an angle of 120° from one another, and the pairs of straps and the tube extend on one end into the tubular mast, with contact of the pairs of straps with the inside of the tubular mast, and on the other extend beyond the tube section. This makes it possible on the one hand to prefabricate the attachment piece as a separate component and on the other to secure the cables joined to the transversal tubes to the part of the attachment piece protruding from the tubular section. For easy mounting of the cables connected to the transversal tubes on the attachment piece, in an advantageous feature of the invention, each pair of straps of the tube of the attachment piece, in the upper region, carries a transversely extending screw bolt, which is secured by a nut and is joined to an eye secured to the cable extending to the corresponding transversal tube. To allow water that gets into the tube of the attachment piece to run out, advantageously a water drain opening is let into the bottom plate of the tube.

In a further characteristic of the invention, to attain a simple connection between the cables and the transversal tubes, each transversal tube, on its free end, carries one pair of straps for receiving a screw bolt, which is secured by a nut and is joined to an eye that is secured on the cable extending to the corresponding pair of straps of the tube of the attachment piece.

Further, one protruding support for two adjacent support tubes is preferably inserted into each transversal tube from the free face end. Thus the possibility of disposing two support tubes next to one another on one transversal tube is achieved in a simple way. Suitably, the T-shaped support has two opposed arms, angles toward the transversal tube and having an end piece bent upward at a right angle, and the support tubes are suspended from the arms of the support via a suitable lateral opening. The bent end piece prevents the support tube from slipping out of the support.

In a further advantageous feature of the invention, to achieve simple fixation of the support inside the transversal tube, the crosspiece of the support is provided with a threaded journal protruding at a right angle, which extends through a bore in the transversal tube and is secured in its position by a nut.

In a further characteristic of the invention, to achieve a simple connection of the tension cables to the support tubes, the lower ends of the support tubes have a bore, and one two-armed claw each engages the bores of two adjacent support tubes and is joined to an eye secured to the associated tensioning cable. So that the tension cables will always be tensed, in another advantageous feature of the invention, each tensioning cable is provided with a tension spring. In a further advantageous feature of the subject of the invention, for rapid attachment of the publicity supports to the support tubes, the canvaslike publicity supports are provided laterally with continuous eyes, through which the support tubes are passed, protruding at the ends. Preferably, the canvaslike publicity supports are fixed on the support tubes by means of screws.

In another advantageous feature of the subject of the invention, to enable the support tubes, which receive the canvaslike publicity supports, to be more easily suspended in the supports and then to carry out bracing of the canvaslike publicity supports, at least one of the transversal tubes is embodied as adjustable in its length. Suitably, the joint associated with the adjustable-length transversal tube has a bearing bush with a threaded rod secured to it, which rod protrudes into the transversal tube through a guide bush inserted from the face end into the transversal tube, and a compression spring surrounding the threaded rod is provided between a knurled nut, which is adjustable on the threaded rod, and the guide bush. Bracing of all the canvaslike publicity supports is effected by means of the compression spring.

To increase the advertising effectiveness, in an advantageous feature of the invention, the canvaslike publicity supports are illuminatable via projectors disposed on the transversal tubes and protruding longitudinally. Preferably, the support for the support tubes of the canvases are embodied as adapter tubes, which laterally mounted arms for receiving the support arms and with a pair of straps mounted on top for receiving the cable connected to the tubular mast, each of which arms receives one support tube for the projector. For selective mounting of the projector, the support tube for the projector is fixed in the adapter tube via a releasable clip connection. For simple securing of the projector, preferably, a receiving flange for the projector is disposed on the underside of the free end of the support tube.

In an advantageous alternative version of the publicity display, in order to increase the advertising effectiveness, the canvaslike publicity supports are transparent and are illuminatable via projectors secured to the tubular mast. Suitably, in the region of the connection, between the middle section and the upper section of the tubular mast, an intermediate tube piece with three receiving flanges, offset by 120° from one another, for the projectors is inserted into the tubular mast.

In another advantageous version of the publicity display, the transversal tubes are each joined via a joint to a lower guide ring of a cage disposed slidably on the tubular mast, and each of the transversal tubes are held in their horizontal position by a respective cable secured to the free end of the transversal tube and to an upper guide ring of the cage, and the cage is movable into the desired position via a chain or rope drive. This has the substantial advantage that when the publicity display is assembled and dismantled, no ladders are needed even for the same structural height, since the publicity supports connected to the cage are movable to the desired position in terms of height by means of the chain or rope drive.

To achieve a reliable rope drive on the one hand and on the other a compact disposition of the rope drive, in a further feature of the subject of the invention, the rope drive includes a cable drum actuatable via a disengageable, self-locking crank, which drum is supported in a rectangular tube accommodated inside the lower region of the lower individual section of the tubular mast and joined to the support pan of the tubular mast. For reliable joining of the rectangular tube to the tubular mass, the outside of the rectangular tube is preferably provided with at least one pair of opposed curved sections, which rest on the inside of the lower individual section of the tubular mast and are screwed to it. For guiding the cable of the rope drive inside the lower individual section of the tubular mast, the rectangular tube suitably has an inverted-U-shaped bail on its outside, extending as far as the upper end of the lower individual section of the tubular mast, and the crosspiece of the bail has a through opening for the cable of the rope drive.

For simple embodiment of the cage, preferably the guide rings of the cage are coupled to one another via three connecting ribs that are at an angle of 120° from one another. Suitably, the upper guide ring of the cage has three pairs of straps, at an angle of 120° from one another; each pair of straps, in its lower region, receives a transversely extending screw bolt, to which the cable extending to the corresponding transversal tube is secured, and in its upper region receives a spring-loaded latch, which in the end position of the cage rests on an encompassing shoulder of a top piece inserted into the face end of the upper individual segment of the tubular mast. Reliable relief of the rope drive in the end position of the cage is thus obtained. Preferably, the top piece has a central opening extending longitudinally, in which, via ribs distributed uniformly over the circumference, a receiving tube that rotationally movably receives a flagpole is fixed, which receiving tube is provided with a bottom plate that has a water drain opening. For easy rotatability of the flagpole, suitably, a pointed cone is inserted into the underside of the flagpole, its tip resting on the bottom plate of the receiving tube.

To attain a reliable deflection of the rope drive and simple securing of it to the cage, in a further advantageous feature of the invention, above the top piece, a deflection roller for the cable of the rope drive is fixed to the top piece via a mount, and the end of the cable is secured to a hook mounted on the outside of the upper guide ring of the cage. To prevent the cable from pivoting out of the deflection roller, preferably the mount for the deflection roller, on its top, is assigned a securing lever that is displaceable in spring-loaded fashion. For precise delivery of the cable to the deflection roller, preferably a guide tube for the cable of the rope drive is disposed inside the upper individual section of the tubular mast.

In order to assure satisfactory movement of the cage up and down to its final position, in an advantageous further feature of the subject of the invention, when the cage is raised the spring-loaded latches change to a horizontal unlatching position above the top piece, and in the ensuing downward motion of the cage they first assume an upward-pointing lowering position, resting on the tubular mast, and then a downward-pointing readiness position on the tubular mast, by means of oblong slots suitably let into the tubular mast.

BRIEF DESCRIPTION OF THE DRAWINGS

The concept on which the invention is based is described in further detail in the ensuing description in terms of several exemplary embodiments, which are shown in the drawing. Shown are.

DETAILED DESCRIPTION OF THE PREFERRED EMBODIMENTS

Figure 1:
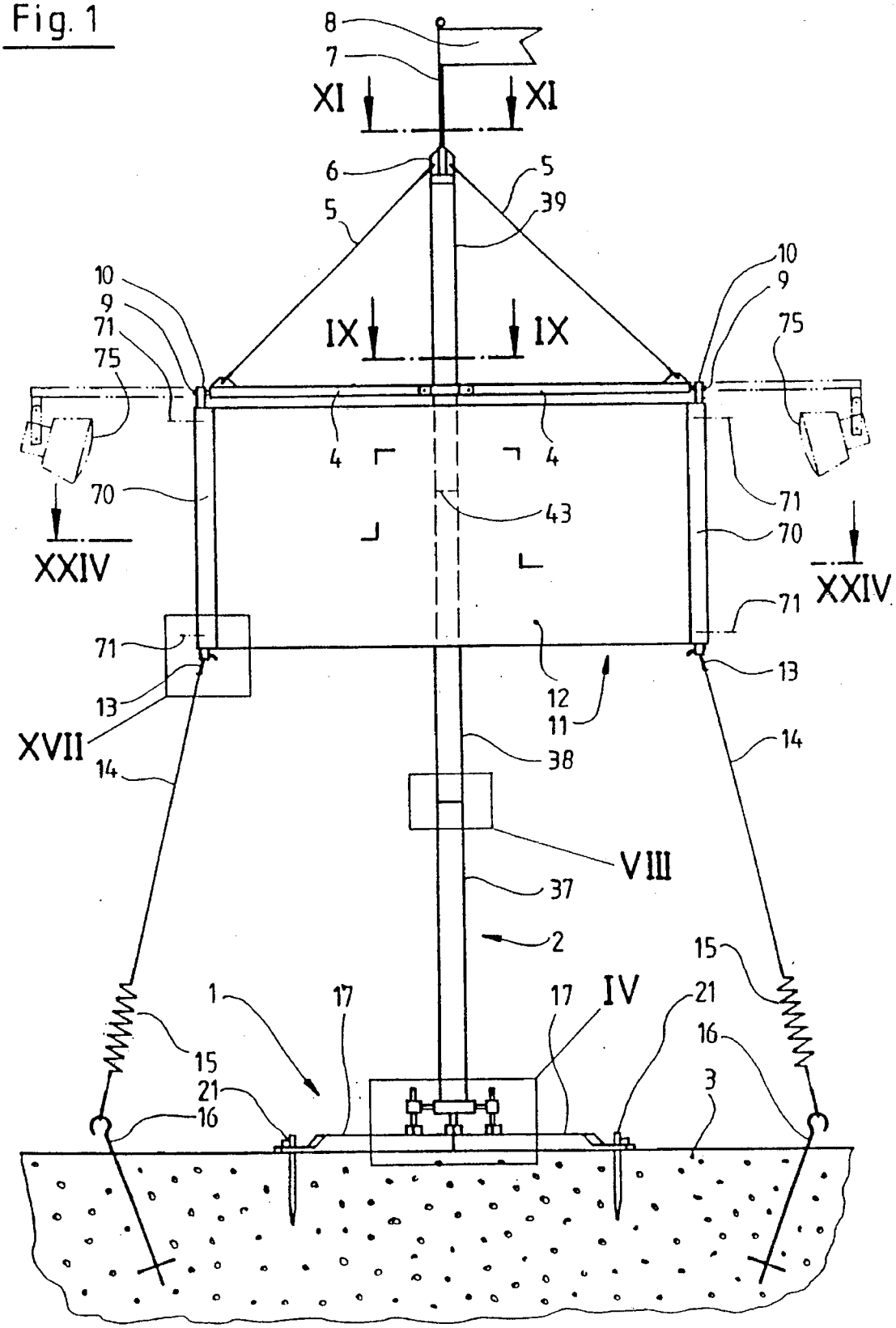
FIG. 1, a front view of a publicity display according to the invention, with alternatively provided projectors.
Figure 2:
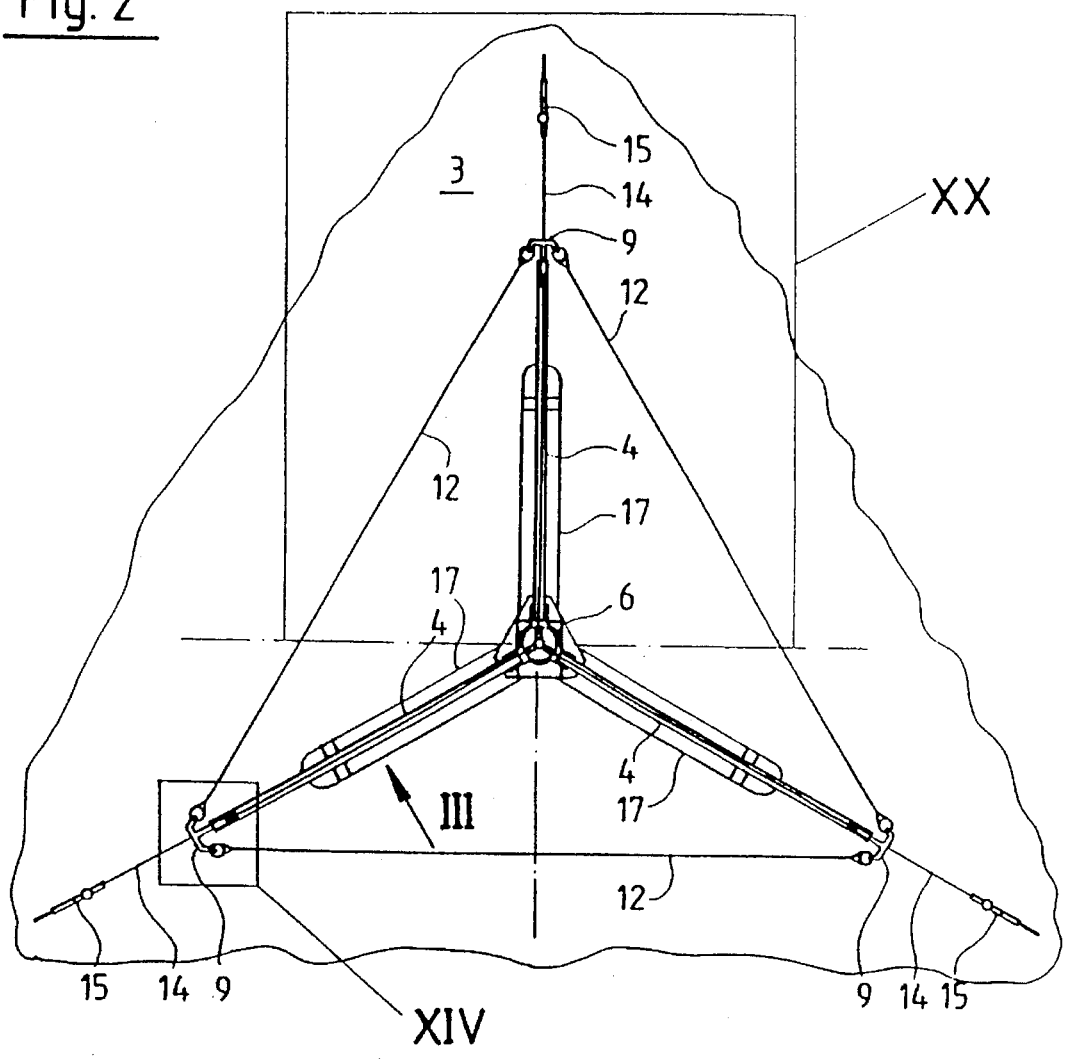
FIG. 2, a plan view of the illustration of FIG. 1.

As shown in FIGS. 1 and 2, the publicity display setup in the open includes a tubular mast 2, provided with a base 1, on which mast three transversal tubes 4, at an angle of 120° from one another, are disposed at a specified distance at the ground 3. From the free end of each transversal tube 4, a cable 5 extends to an attachment piece 6 on the top of the tubular mast 2; this piece receives a flagpole 7 with a flag 8. Also secured to the free end of each transversal tube 4 is a support 9 for receiving two adjacent support tubes 10, extending parallel to the tubular mast 2, of which each two support tubes 10 opposite adjacent transversal tubes 4 between them receive one publicity support 11. Each publicity support 11 comprises a rectangular flexible canvas 12 with an advertisement mounted to its front. In plan view, the canvaslike publicity supports 11 accordingly form a closed equilateral triangle. On their lower end, the immediately adjacent support tubes 10 are each connected via a claw 13 to a tensioning cable 14, which with the incorporation of a tension spring 15 is connected to a ground anchor 16 let into the ground 3. Protruding projectors 75 for illuminating the canvases 12 can be secured to the free ends of the transversal tubes 4.

Figure 3:
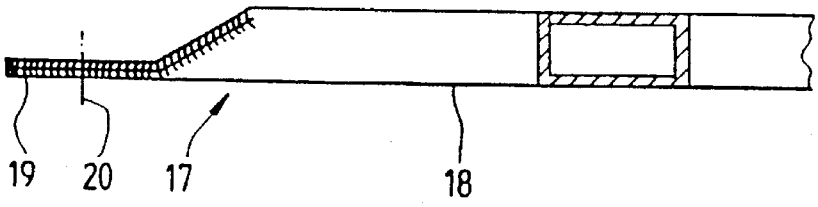
FIG. 3, a fragmentary view of the illustration of FIG. 2 in the direction of the arrow III.
Figure 4:
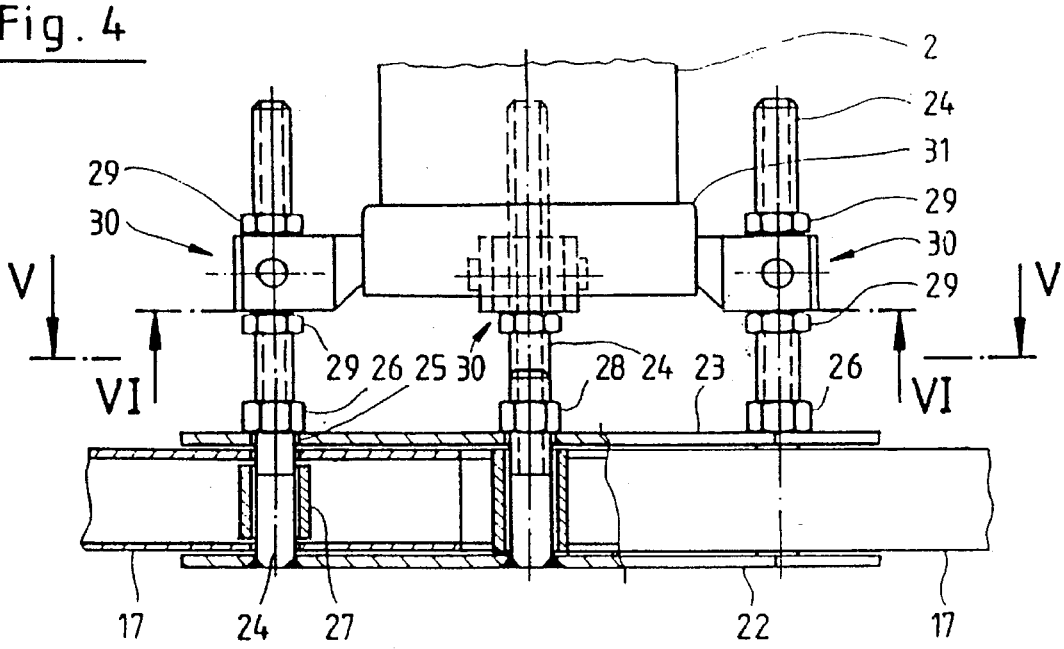
FIG. 4, an enlarged view of the detail (IV) of FIG. 1, in a section taken along the line IV—IV of FIG. 5.
Figure 5:
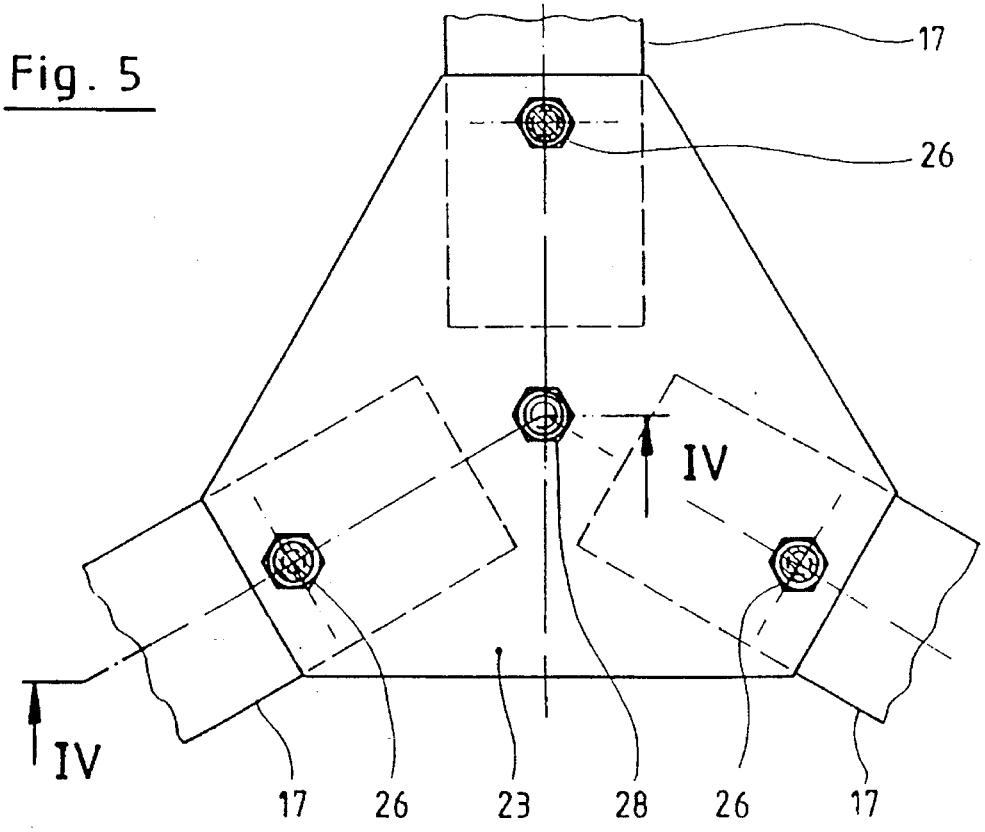
FIG. 5, a section taken through the view of FIG. 4 along the line V—V.
Figure 6:
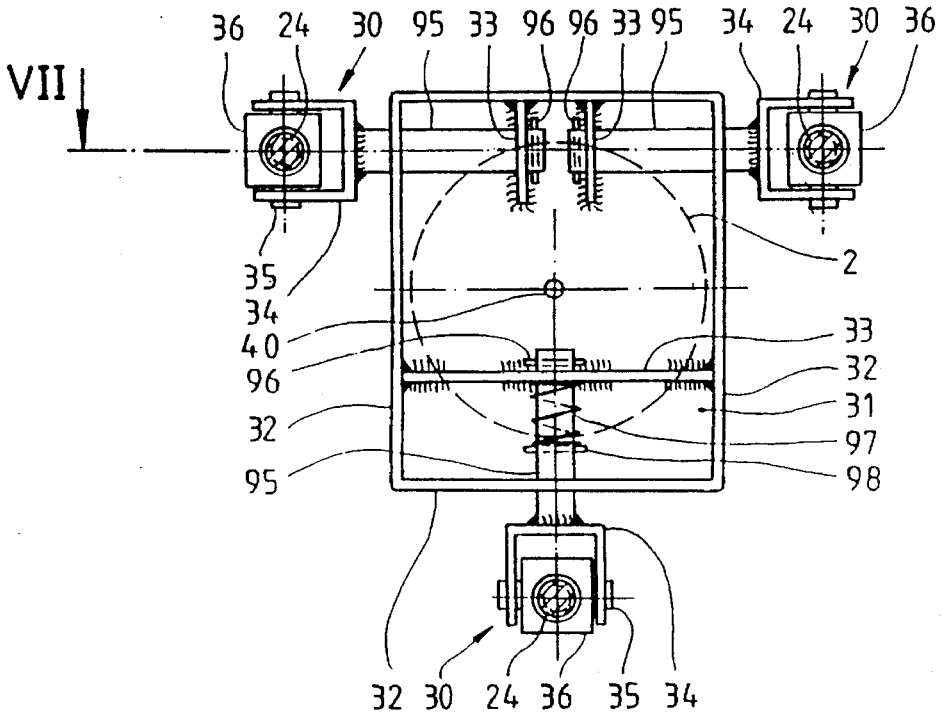
FIG. 6, a section taken through the view of FIG. 4 along the line VI—VI.
Figure 7:
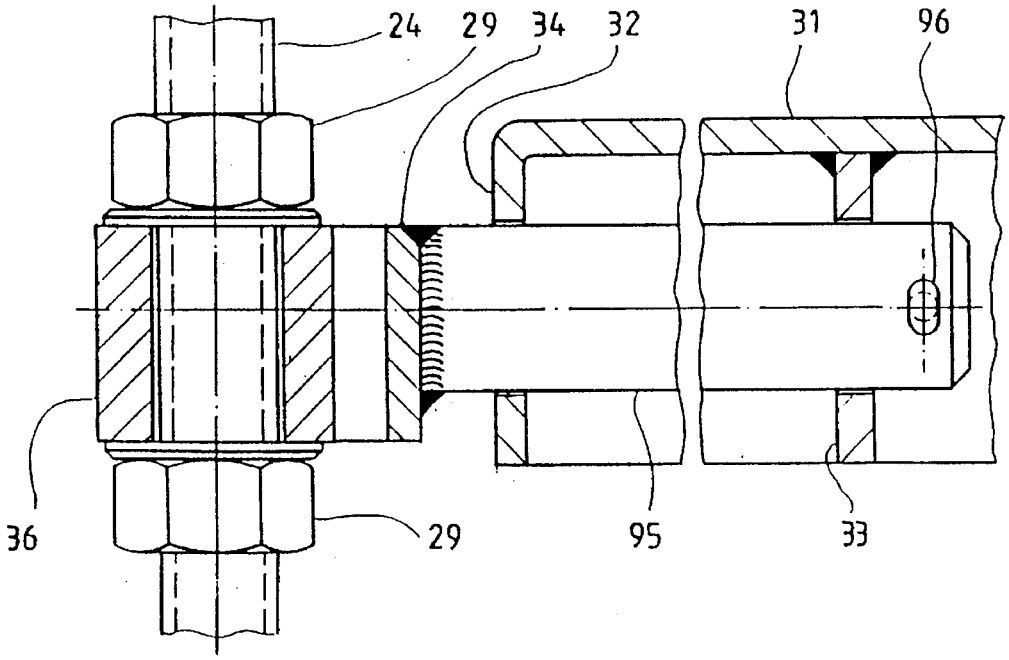
FIG. 7, an enlarged fragmentary section through the view of FIG. 6 in the direction of the arrow VII.
Figure 8:
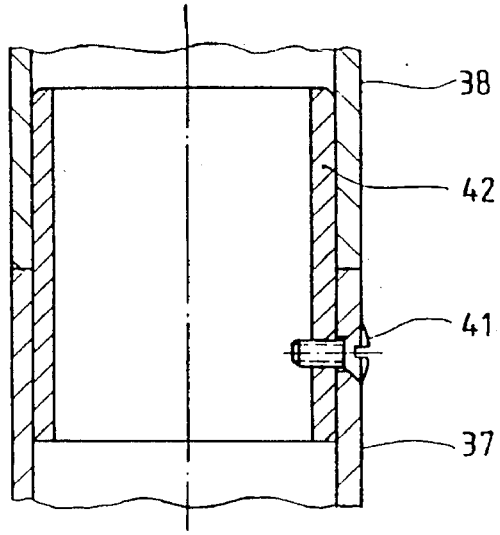
FIG. 8, an enlarged view of the detail VIII of FIG. 1 in section.
Figure 9:
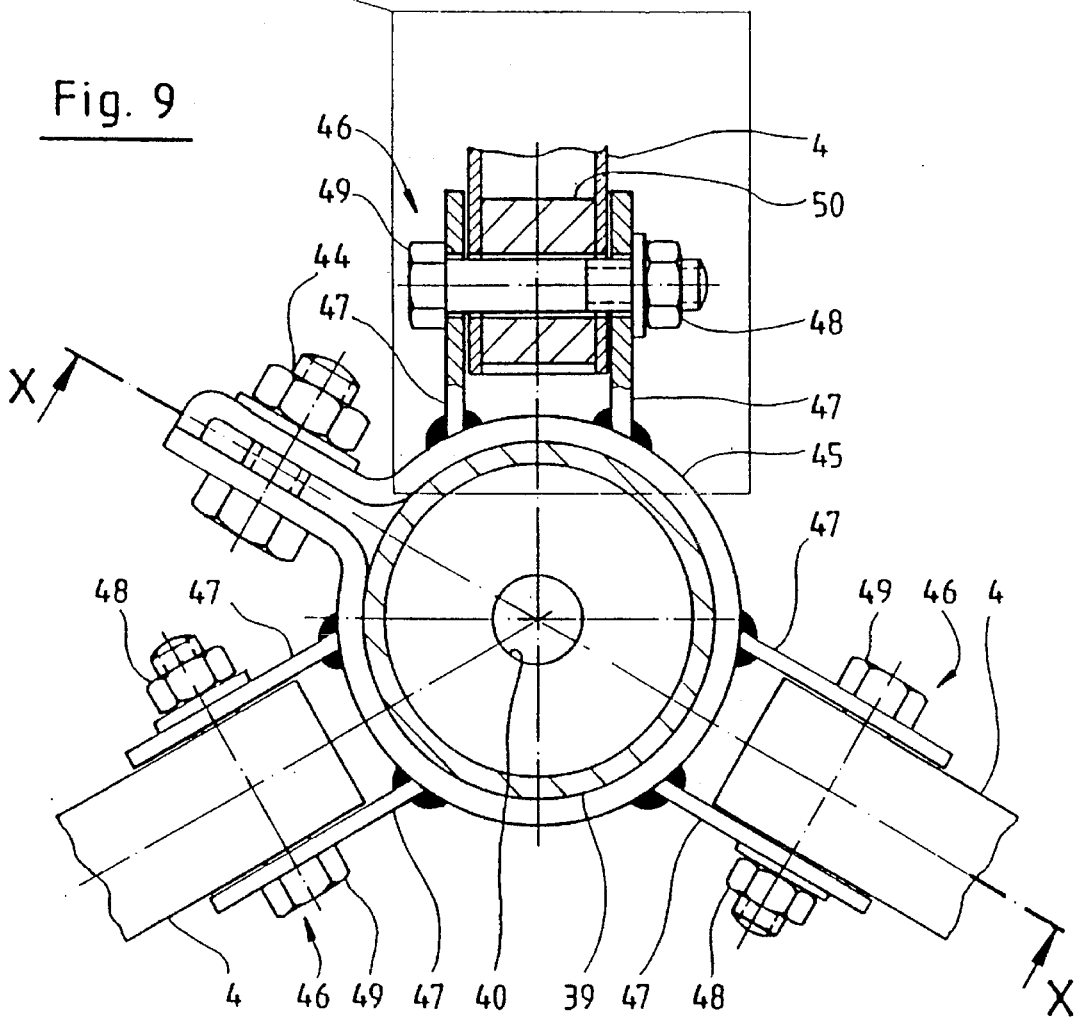
FIG. 9, a fragmentary section through the view of FIG. 1 along the line IX—IX on a larger scale.
Figure 10:
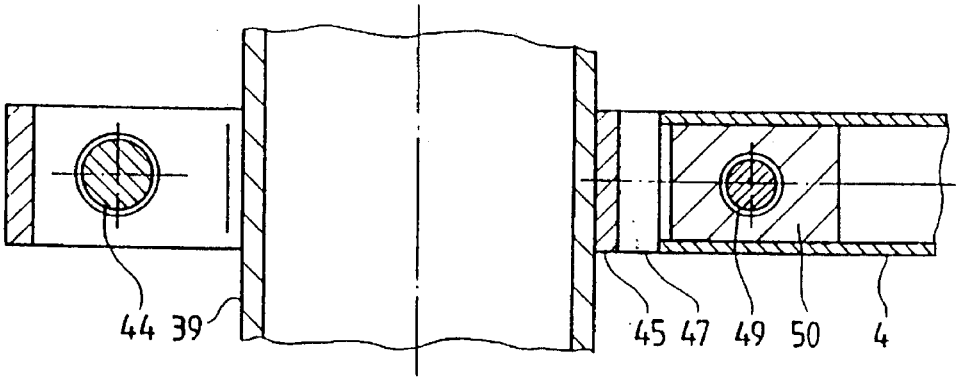
FIG. 10, a section through the view of FIG. 9 along the line X—X.
Figure 11:
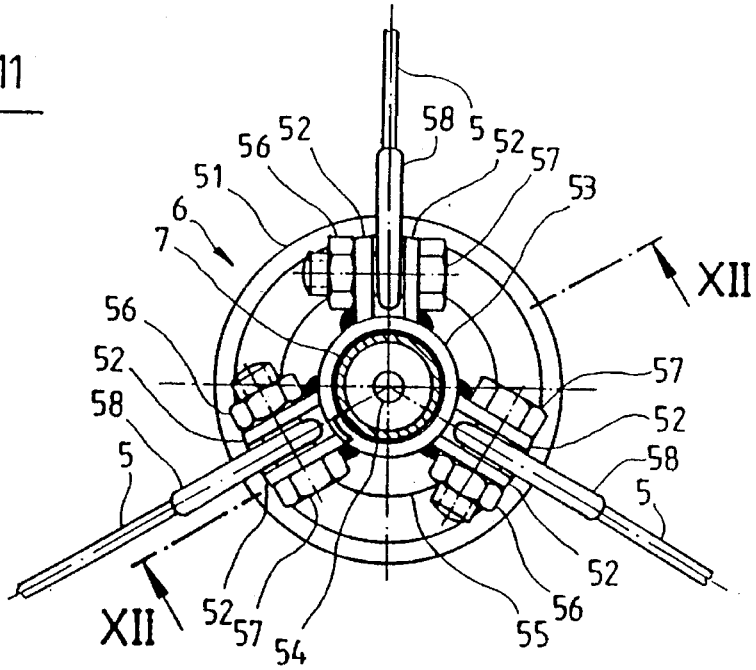
FIG. 11, a section through the view of FIG. 9 along the line XI—XI, on a larger scale.
Figure 13:
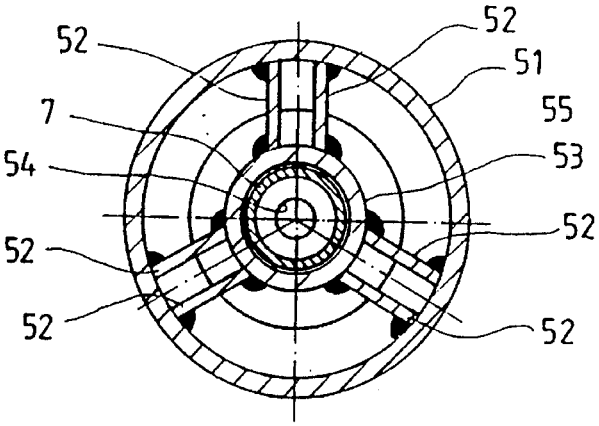
FIG. 13, a section through the view of FIG. 9 along the line XIII—XIII.
Figure 12:
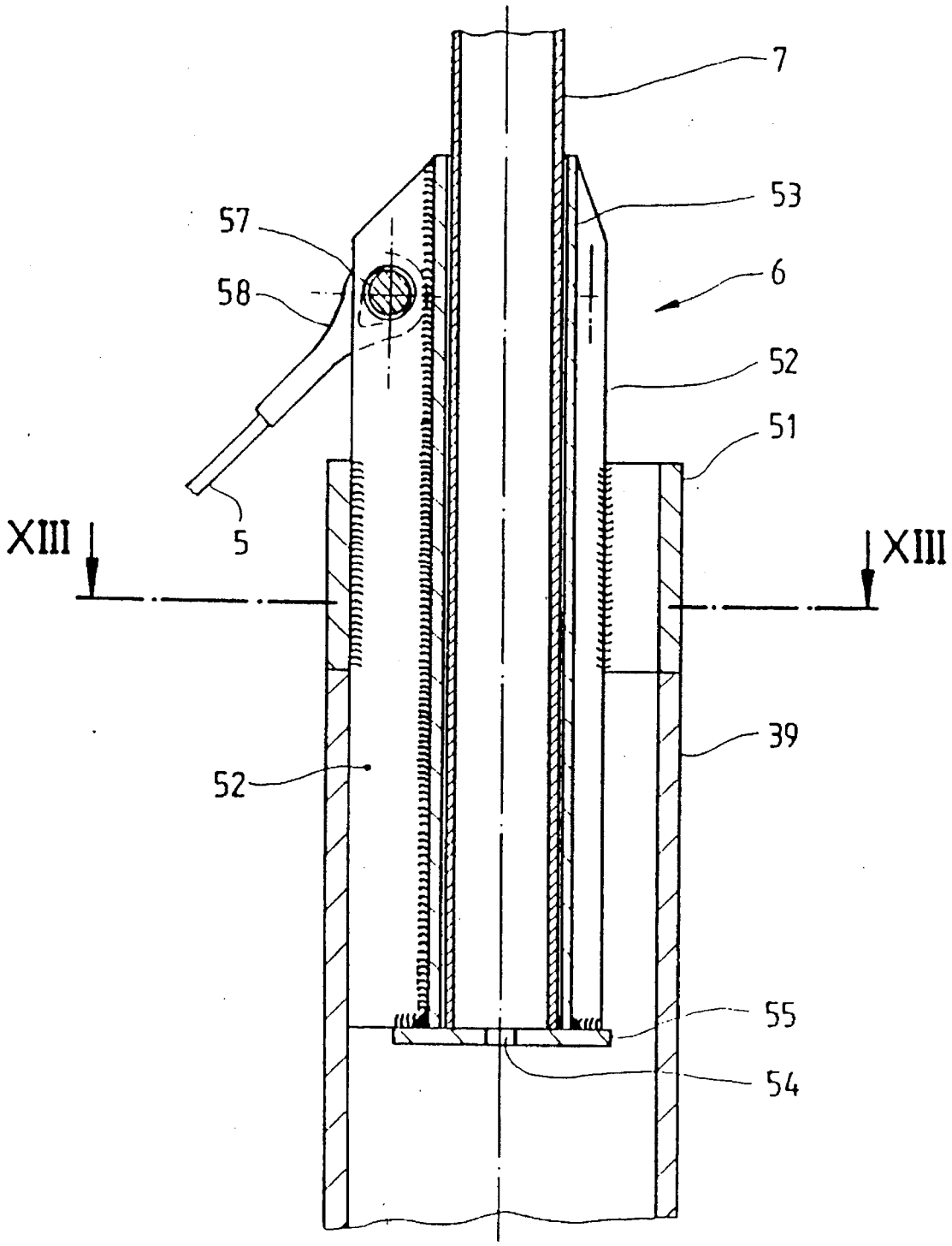
FIG. 12, a section through the view of FIG. 9 along the line XII—XII.

Referring additionally to FIGS. 3 to 5, the base 1 has three arms 17, at an angle of 120° from one another, which are aligned in the direction of the transversal tubes 4. Each arm 17, comprising a rectangular tube 18, has one region 19 on its free end that is flattened toward the ground and into which a through bore 20 is let for receiving a ground nail 21. On their other ends, the arms 17 are joined into a junction point by means of a triangular bottom plate 22 and a triangular top plate 23. Each arm 17 is pivotably supported about a screw bolt 24 that is permanently connected to the bottom plate 22, extends through an opening 25 in the top plate 23, and protrudes above the top plate 23 over a relatively wide region. The screw bolt 24 is secured in its position via a nut 24. A spacer tube 27 surrounds the screw bolt 24 inside the hollow arm 17. The bottom plate 22 and top plate 23 are held together in the center by a screw and nut connection 28. Each of the protruding ends of the screw bolts 24 are joined to an inverted support pan 31 receiving the tubular mast 2 via a cardan joint 30 that is fixed to the associated screw bolt 24 via two nuts 29. Referring also to FIGS. 6 and 7, each cardan joint 30 is composed of a fork 34, rotationally movably supported in the associated side wall 32 of the support pan 31 and in an associated retaining plate 33 secured to the support pan 31, and a bearing eye 36 rotationally movably supported in the fork 34 on a bolt 35. The bearing bolt 95 of each fork 34 is secured in its position by a pin 96 engaging the retaining plate 33 from behind. The fork 34 of a cardan joint 30 is received in the support pan 31 so as to be longitudinally displaceable counter to the force of a spring 97; the spring 97 surrounding the bearing bolt 95 is supported at one end on a pin 98 extending through the bearing bolt 95 and on the other on the retaining plate 33. The tubular mast 2 is subdivided into three detachably interconnected individual sections 37, 38, 39 (see FIG. 1). The lower individual section 37, by its bottom end, is centrally permanently disposed on the top of the support pan 31. As shown in FIG. 9, a water drain opening 40 is located in the support pan 31, centrally with respect to the lower individual section 37. Referring to FIG. 8, on its upper end, the lower individual section 37 has a protruding inner tube 42, fixed by a screw 41, onto which tube the lower end of the middle individual section 38 is mounted. The connection 43 between the middle individual section 38 and the upper individual section 39 of the tubular mast 2 is embodied analogously.

At a specified distance from the attachment piece 6, a pipe clamp 45 fixed by a screw connection 44 surrounds the upper section 39 of the tubular mast 2. On the outside of the pipe clamp 45, the transversal tubes 4 are secured via three equally-spaced-apart joints 46. Each joint 46 comprises one pair of straps 47, mounted on the outside of the pipe clamp 45, with a transversely extending pivot pin 49 that is secured by a nut 48 and rotationally movably receives the corresponding end, reinforced by an insert piece 50, of the transversal tube 4.

Referring now to FIGS. 10–13, the attachment piece 6 includes a pipe section 51, which rests on the face end of the upper individual section 39 of the tubular mast 2 and is connected to a tube 53 located on the inside, via three pairs of straps 52 that are at an angle of 120° from one another. Both the tube 53 and the pairs of straps 52 extend on the one hand a certain distance into the interior of the upper section 39 of the tubular mast 2 and on the other a certain distance past the tube section 51.

Figure 14:
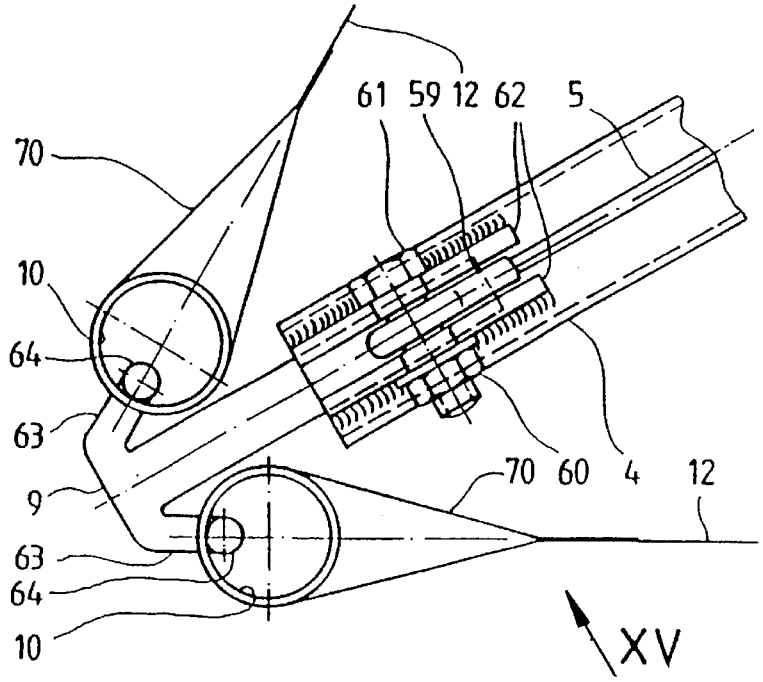
FIG. 14, an enlarged view of the detail XIV of FIG. 2.
Figure 15:
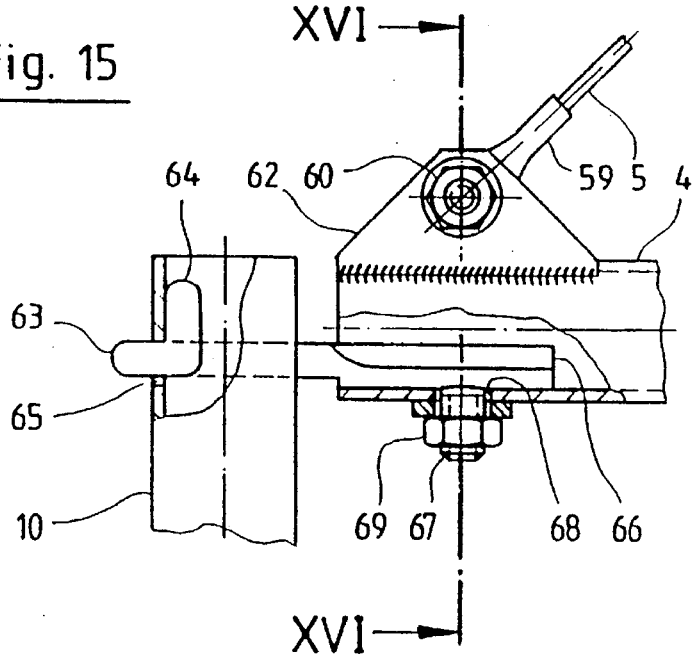
FIG. 15, a view of the illustration of FIG. 14 in the direction of the arrow XV, partly in section.
Figure 16:
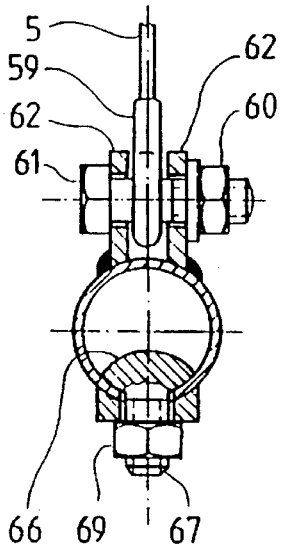
FIG. 16, a section through the view of FIG. 15 along the line XVI—XVI.

In the interior of the individual section 39, the pairs of straps 52 are supported loosely on the inside of the individual section 39 of the tubular mast 2. A bottom plate 55, provided with a central water drain opening 54, closes off the lower end of the tube 53. The flagpole 7 is inserted into the tube 53. Each pair of straps 52, on its end protruding past the tube section 51, receives a transversely extending screw bolt 57 that is secured by a nut 56. An eye 58 is supported rotationally movably on each screw bolt 57 and is secured on the cable 5 leading to the associated transversal tube 4. As shown in FIGS. 14 to 16, an eye 59 is likewise secured to the other of each cable 5 and is rotationally movably connected to a screw bolt 61, which is secured by a nut 60 and is retained in an associated pair of straps 62 mounted on the free end region of the corresponding transversal tube 4. The length of the cable 5 is dimensioned such that the transversal tubes 4 assume a horizontal position.

From the free face end, the support 9 for the adjacent support tubes 10 is inserted into each transversal tube. The support 9 is key-shaped, and its opposed arms 63 are bent at an angle toward the transversal tube 4 and provided with an end piece 64 bent upward at a right angle. Each support tube 10 has a lateral opening 65 in its upper end region, by which it is suspended in the associated arm 63 of the corresponding support 9. The upper end of the support tubes 10 can be closed off by a protective cap. The crosspiece 66, introduced into the transversal tube 4, of the support 9 has on its underside a threaded journal 67, which protrudes at a right angle, extends through a bore 68 in the transversal tube 4, and is fixed in its position by a nut 69. The top of the cross piece 66 of the support 9 is adapted in its contour to that of the transversal tube 4, so that sufficient play will be available when the support 9 is introduced into the transversal tube 4.

Figure 17:
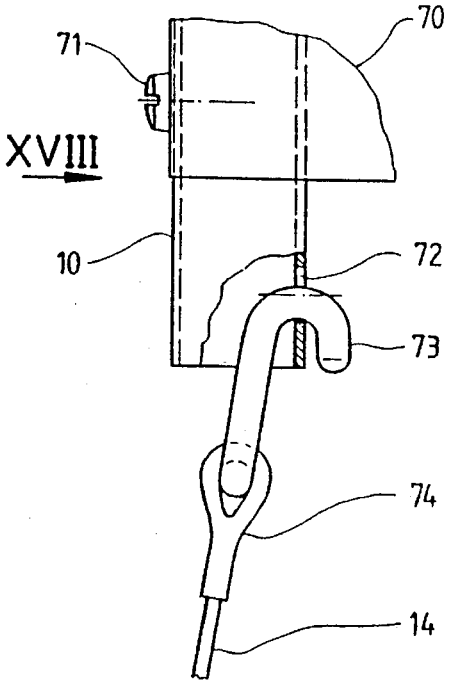
FIG. 17, an enlarged view of detail XVII of FIG. 1, partly in section.
Figure 18:
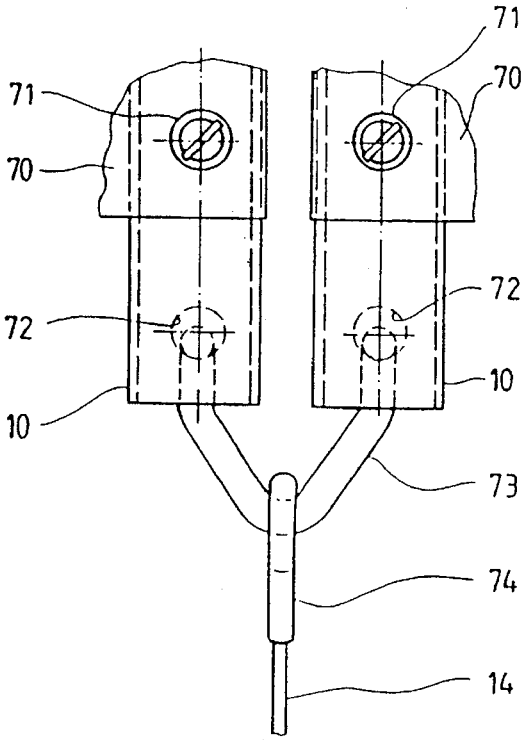
FIG. 18, a view of the illustration of FIG. 17 in the direction of the arrow XVIII.

Referring also to FIGS. 17 and 18, each rectangular canvas 12 has one continuous eye 70 on its short sides, through which the associated support tube 10 is passed with sufficient protrusion at the upper and lower ends; by means of screws 71 opposite the canvas 12 that are screwed into the support tube, the eye 70 is retained in its position. Each support tube 10 is provided with a lateral bore 72 on its lower end, the end protruding past the eye 70 of the canvas 12. One two-armed claw 73 engages the bore 72 of two adjacent support tubes 10, in each case from the inside of the support tubes 10; the claw is coupled to an eye 74 secured to the associated tensioning cable 14.

Figure 19:
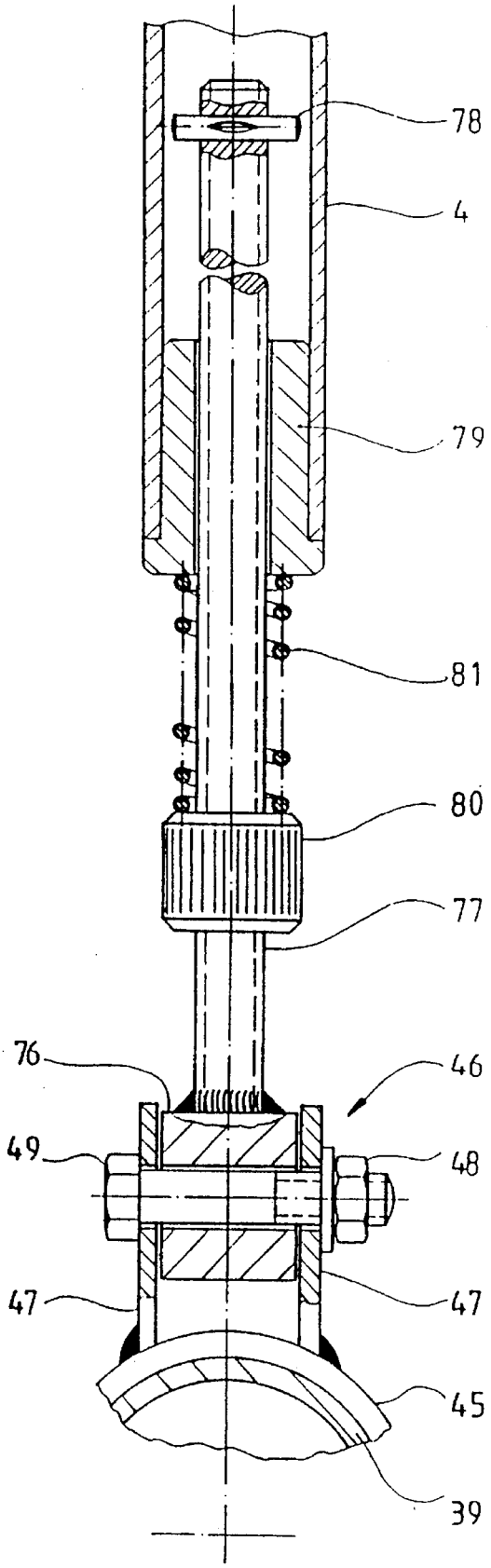
FIG. 19, a view of an alternative version of detail IXX of FIG. 9.
Figures 21, 22:
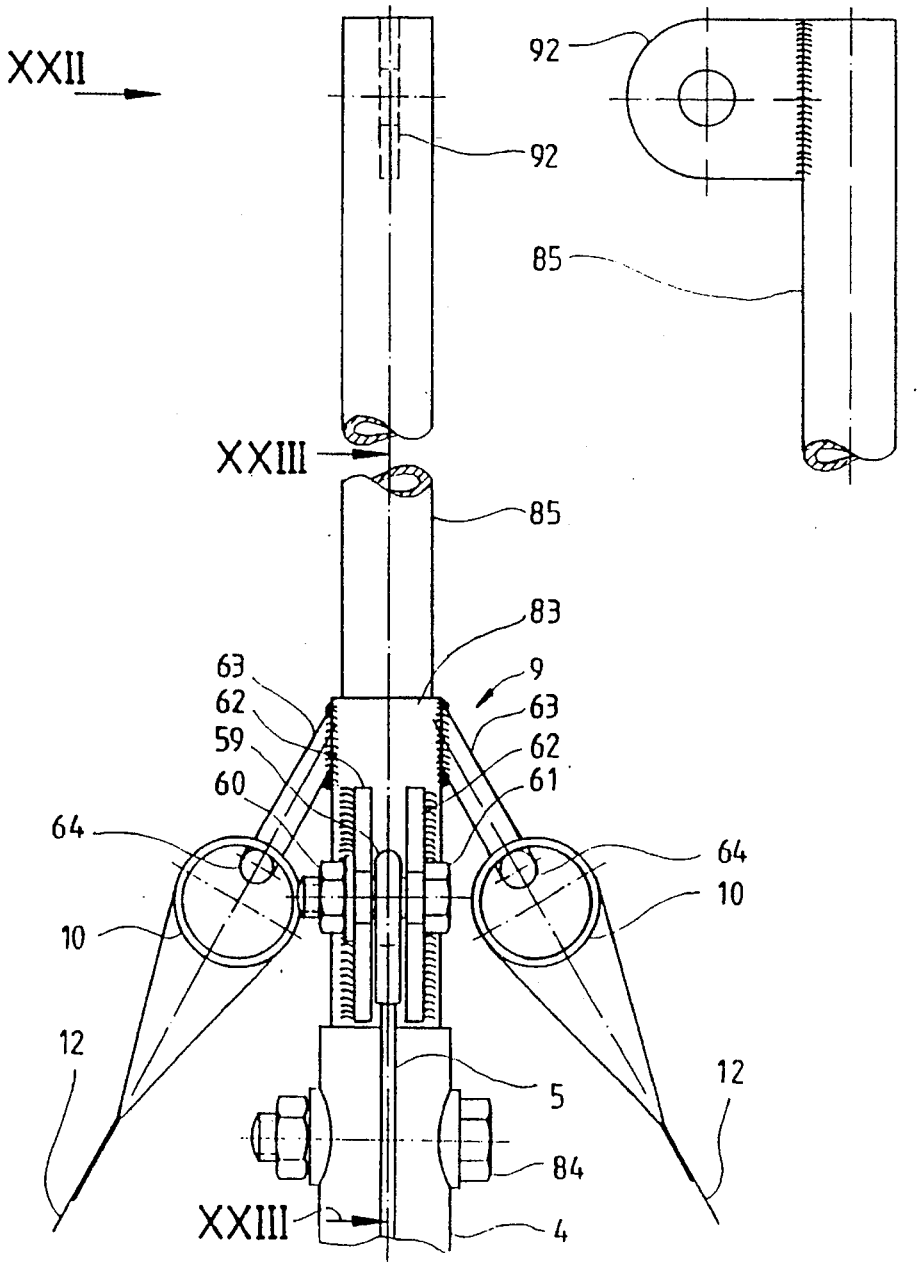
FIG. 21, an enlarged view of the detail XXI of FIG. 20.
FIG. 22, a fragmentary view of the illustration of FIG. 21 in the direction of the arrow XXII.

Referring now to FIG. 19, in an alternative version of the publicity display, at least one transversal tube 4 is retained so as to be adjustable in length on the pipe clamp 45, for the sake of bracing the canvases 12. The joint 46 associated with the adjustable-length transversal tube 4 has a bearing bush 76, to which a threaded rod 77 is secured with a transverse pin 78 on its end. A guide bush 79 is inserted into the transversal tube 4 from the face end, and the threaded rod 77 extends through this bush. A compression spring 81 surrounding the threaded rod 77 is provided between a knurled nut 80, disposed on the threaded rod 77, and the guide bush 79.

Figure 20:
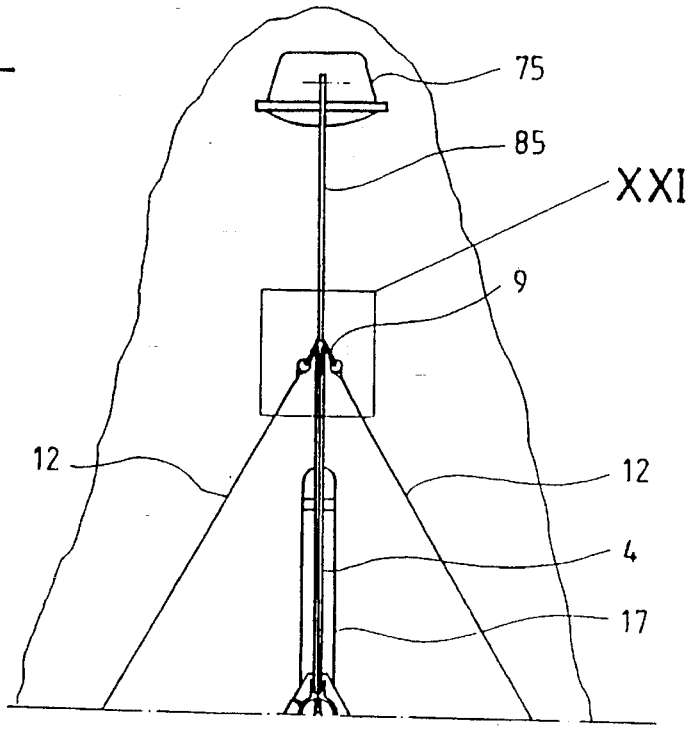
FIG. 20, a plan view of an alternative version of the detail XX of FIG. 2.
Figure 23:
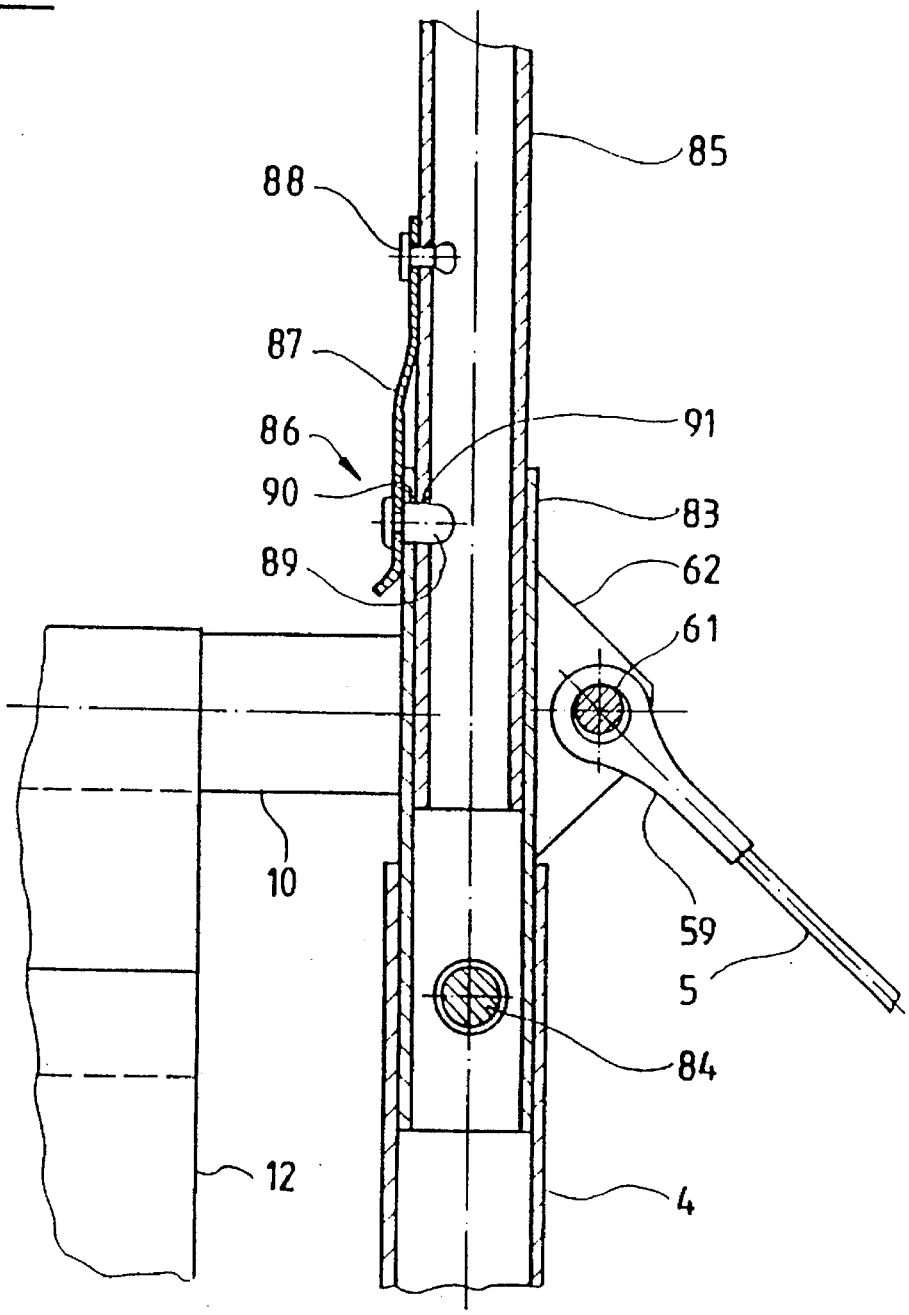
FIG. 23, a section through the view of FIG. 21 along the line XXIII—XXIII.

In another advantageous version of the publicity display shown in FIGS. 20 and 23, the supports 9 for the support tubes 10 each comprise an adapter tube 83, which on one end is fixed in the transversal tube 4 via a screw connection 84 and on the other receives a support tube 85 for the projector 75. In this case, the arms 63 are secured laterally to the adapter tube 83 by their bent end pieces for receiving the adjacent support tubes 10. On its top, the adapter tube 83 carries the pair of straps 62, with the screw bolt 61 secured by a nut 60, the screw bolt being joined to the eye 59 of the cable 5 leading to the attachment piece 6. The support tube 85 is fixed in its inserted position into the adapter tube 83 by a releasable clip connection 86. The clip connection 86 includes a leaf spring 87, which is secured by one end to the support tube 85 by means of a rivet 88 and on its other end carries a journal 89, which engages bores 90 and 91, aligned with one another, of the adapter tube 83 and support tube 85. A receiving flange 92 for the projector 75 is located on the underside of the front end of the support tube 85.

Figure 24:
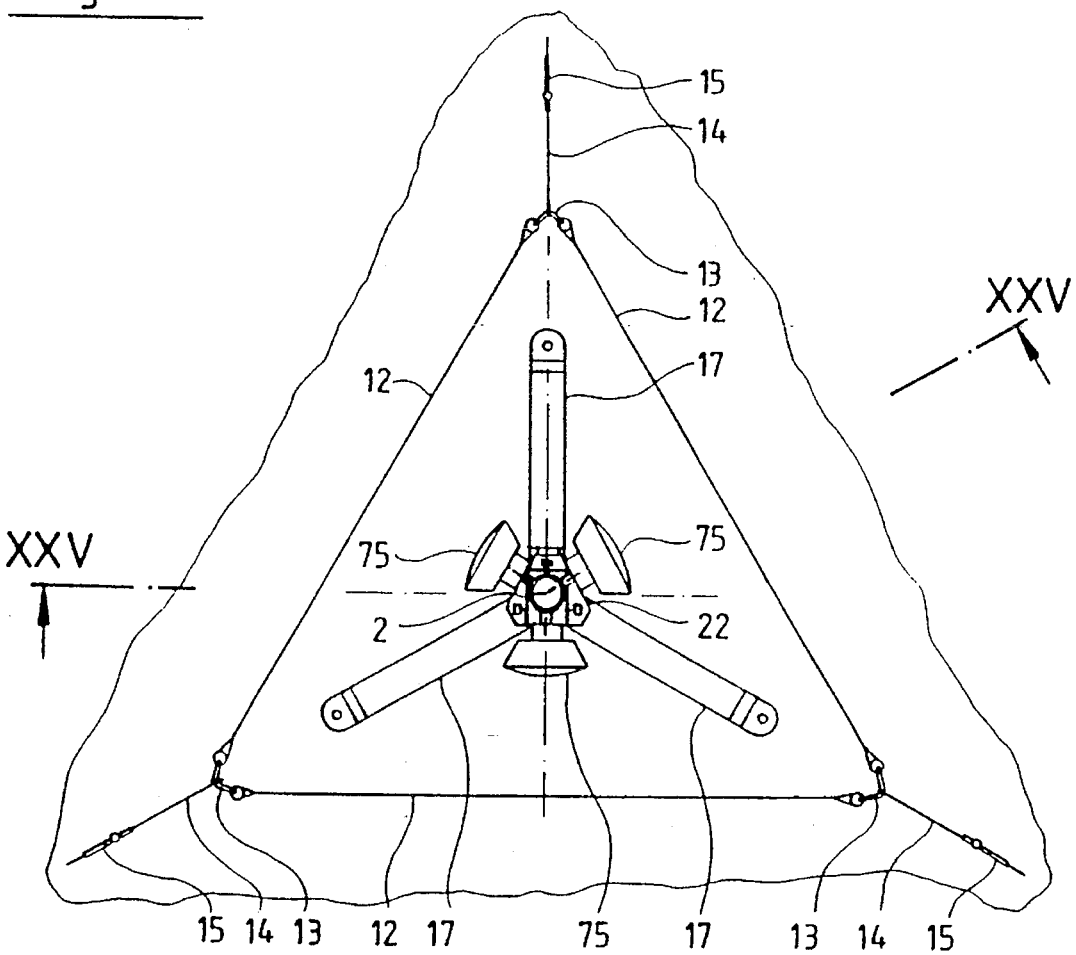
FIG. 24, an alternative version of the publicity display in the region of the section through the view of FIG. 1 along the line XIV—XIV.
Figure 25:
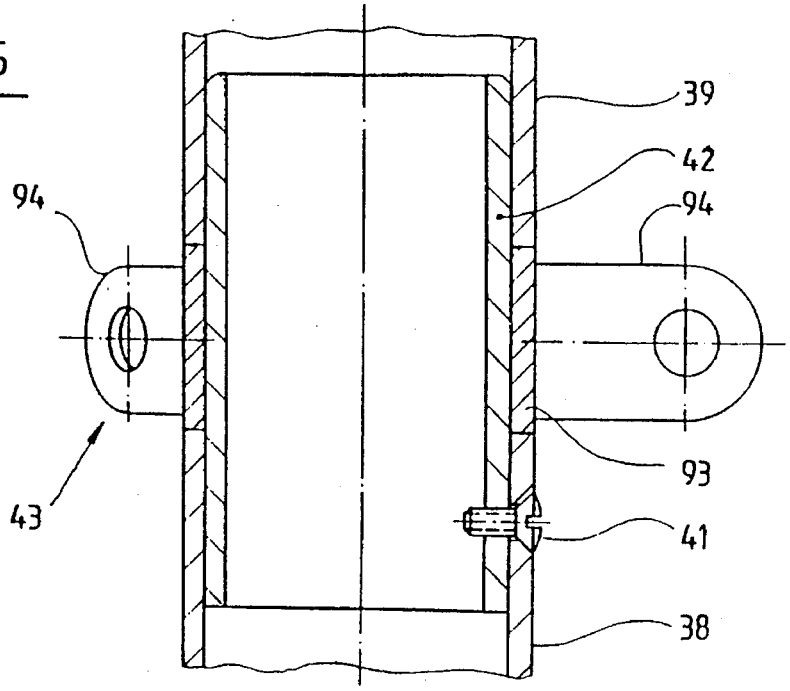
FIG. 25, a section through the view of FIG. 24 along the line XXV—XXV.
Figure 26:
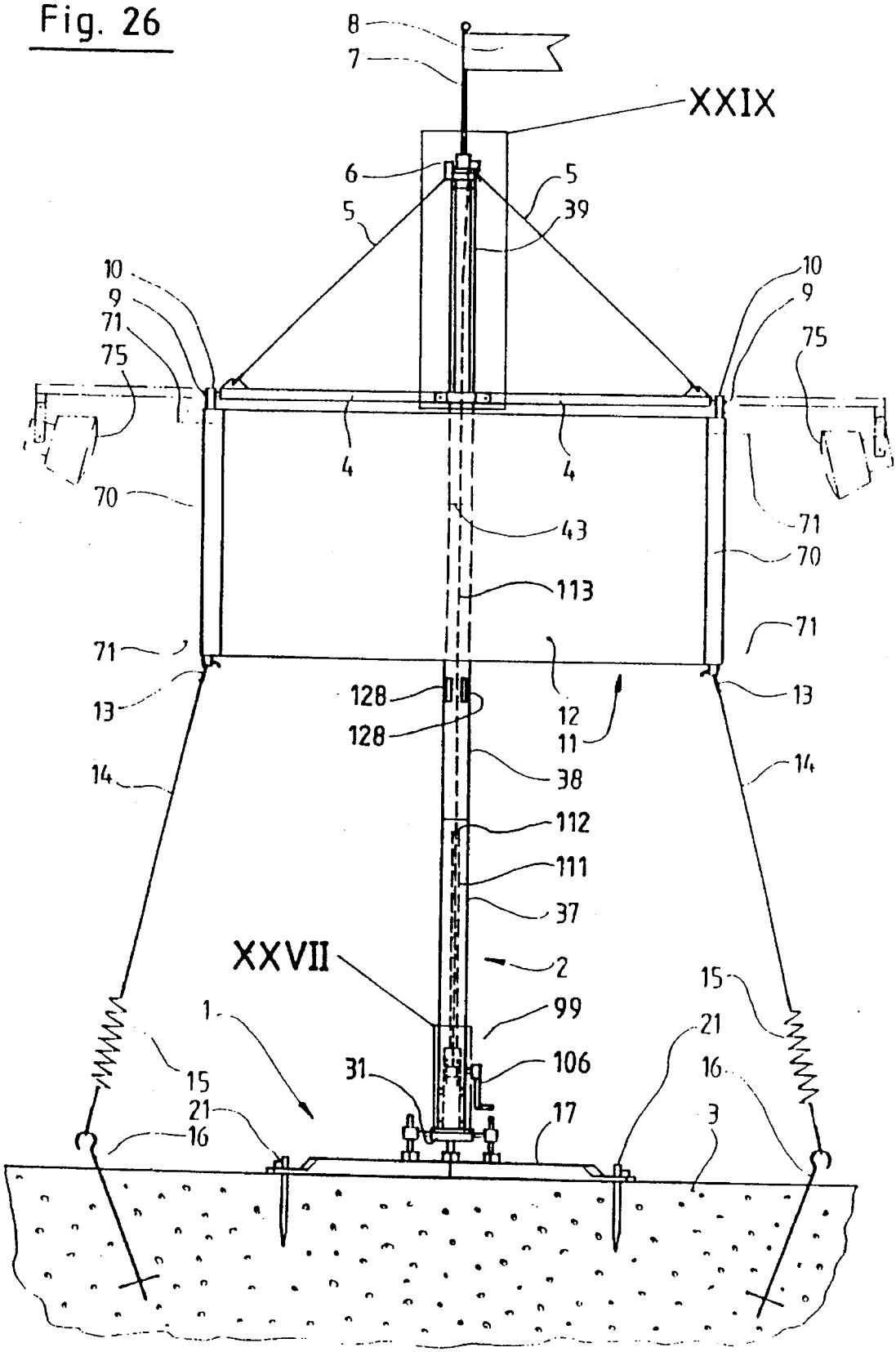
FIG. 26, a front view of an alternative version of a publicity display according to the invention.
Figure 27:
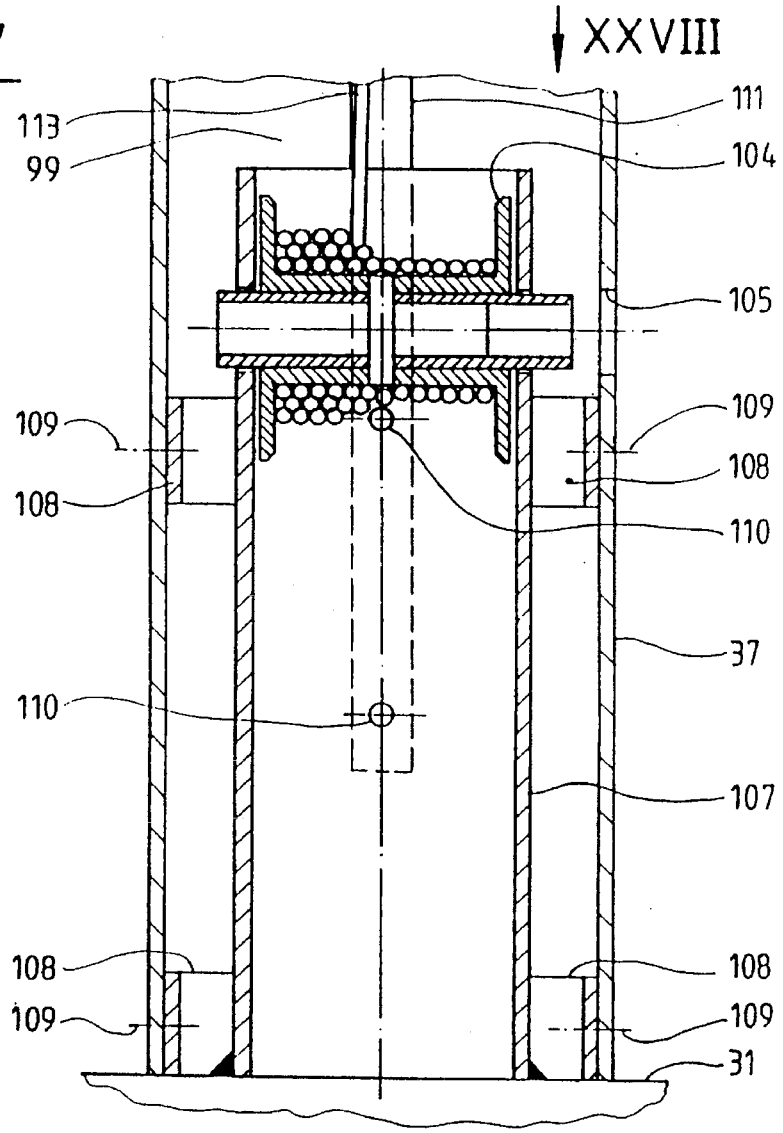
FIG. 27, an enlarged view of the detail XXVII of FIG. 26, in section.
Figure 28:
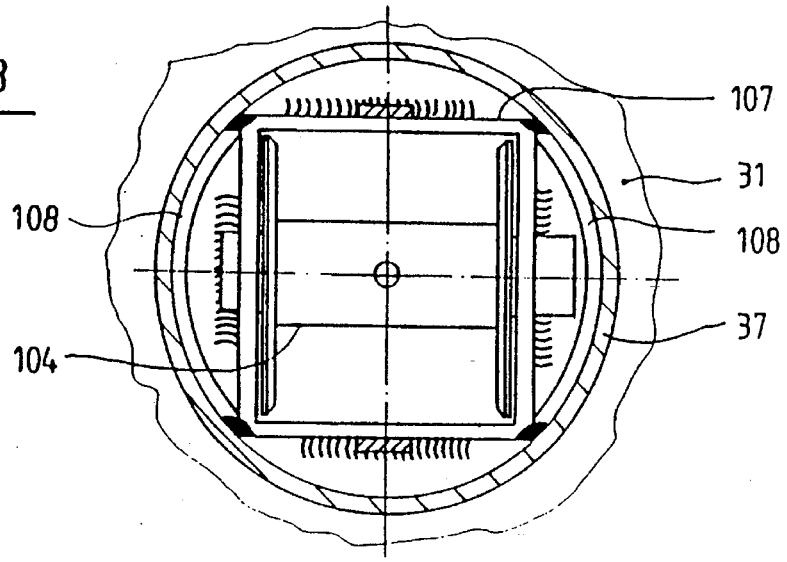
FIG. 28, a plan view of the illustration of FIG. XXVII in the direction of the arrow XXVIII.
Figure 29:
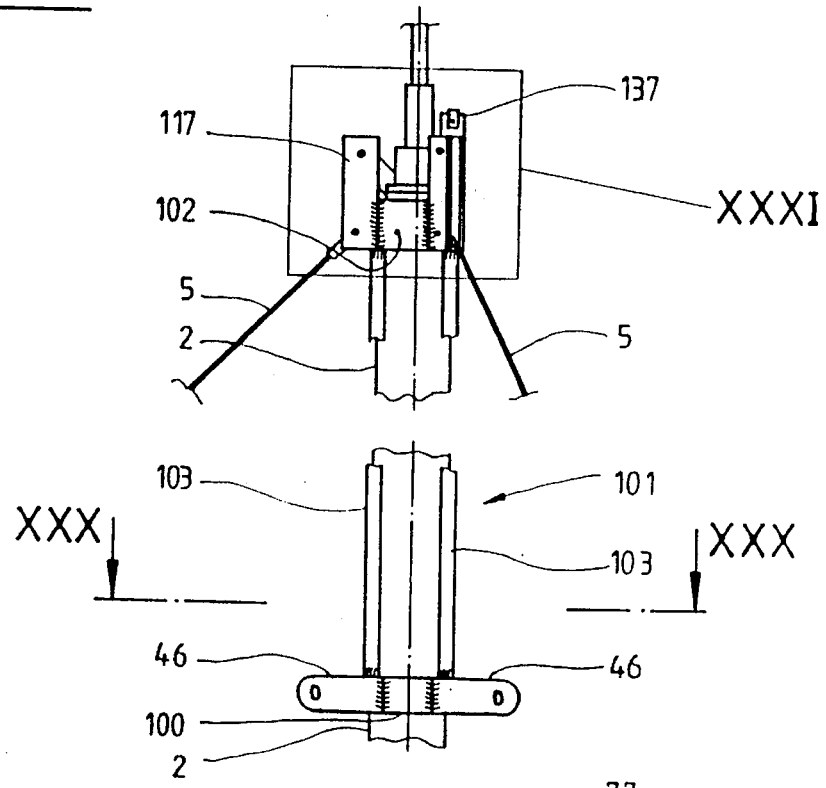
FIG. 29, an enlarged view of the detail XXIX of FIG. 26.
Figure 30:
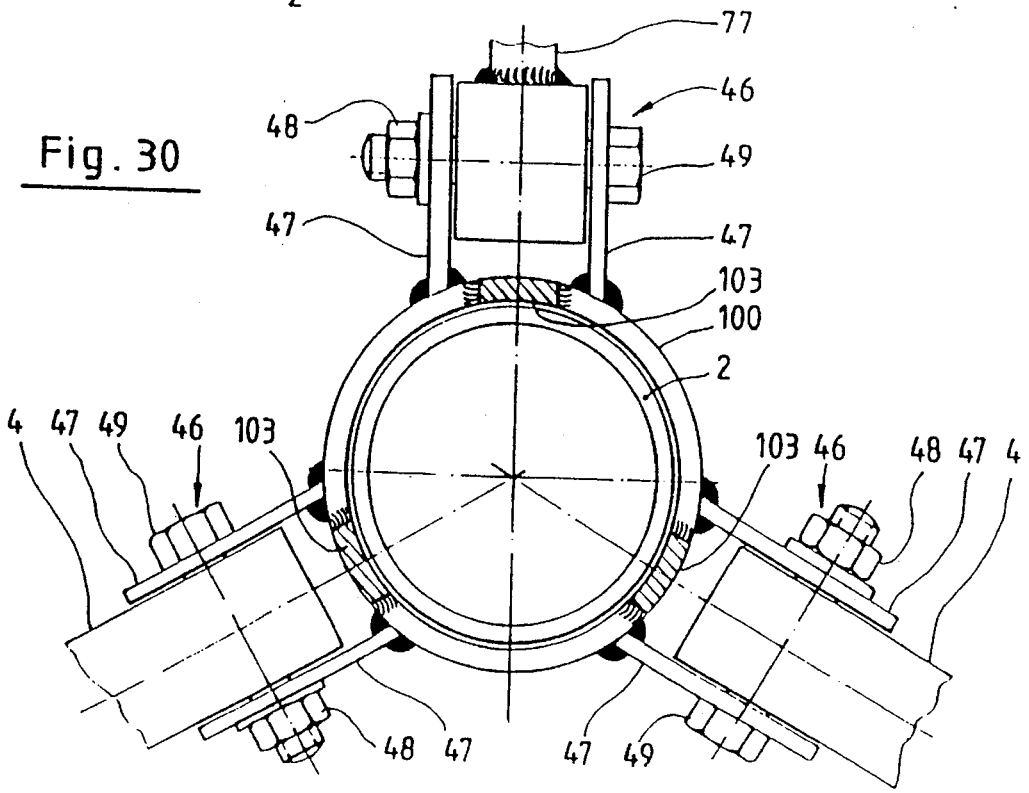
FIG. 30, a section through the view of FIG. 29 taken along the line XXX—XXX on a larger scale.
Figure 31:
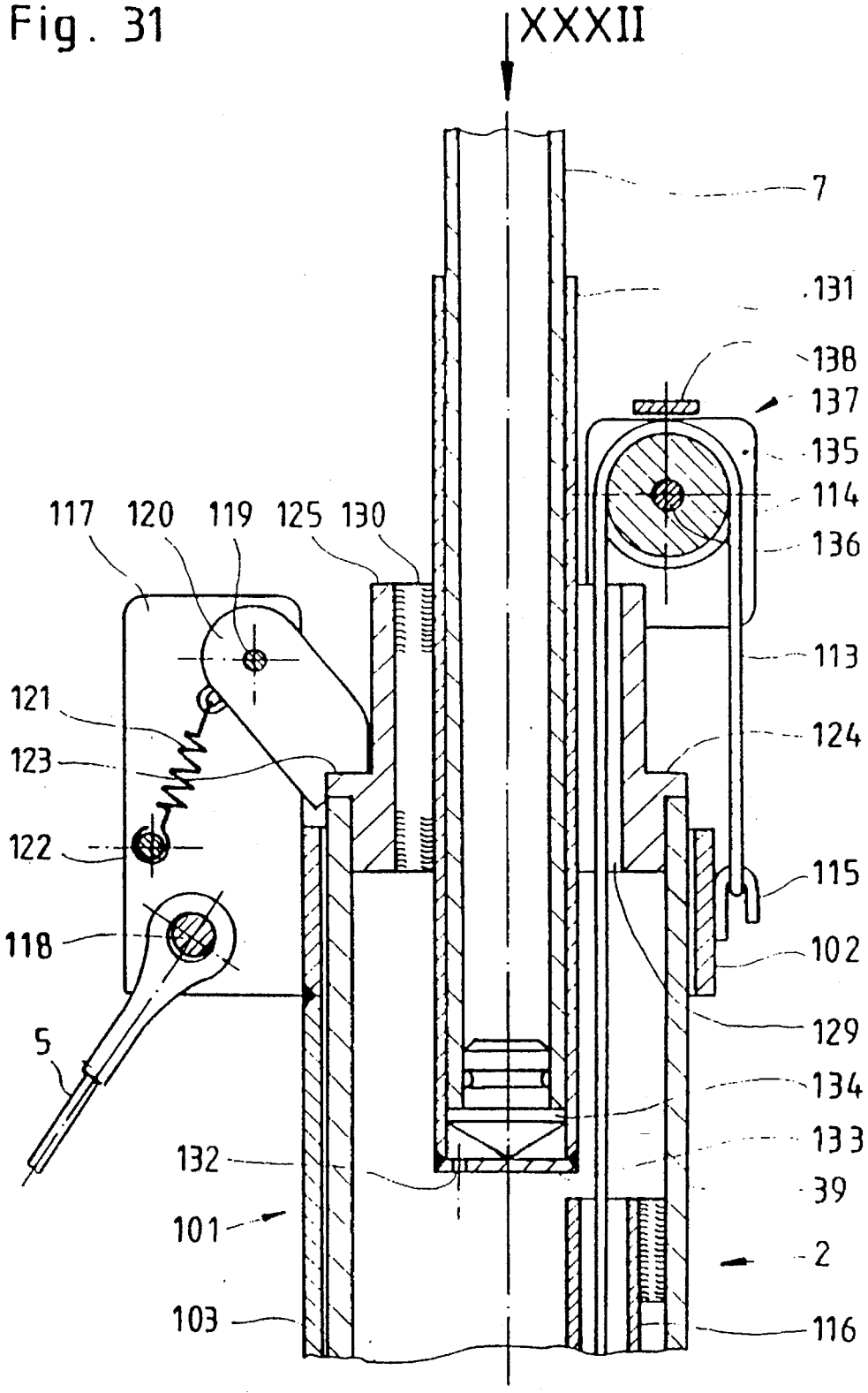
FIG. 31, an enlarged view of the detail XXXI of FIG. 29 in section.
Figure 32:
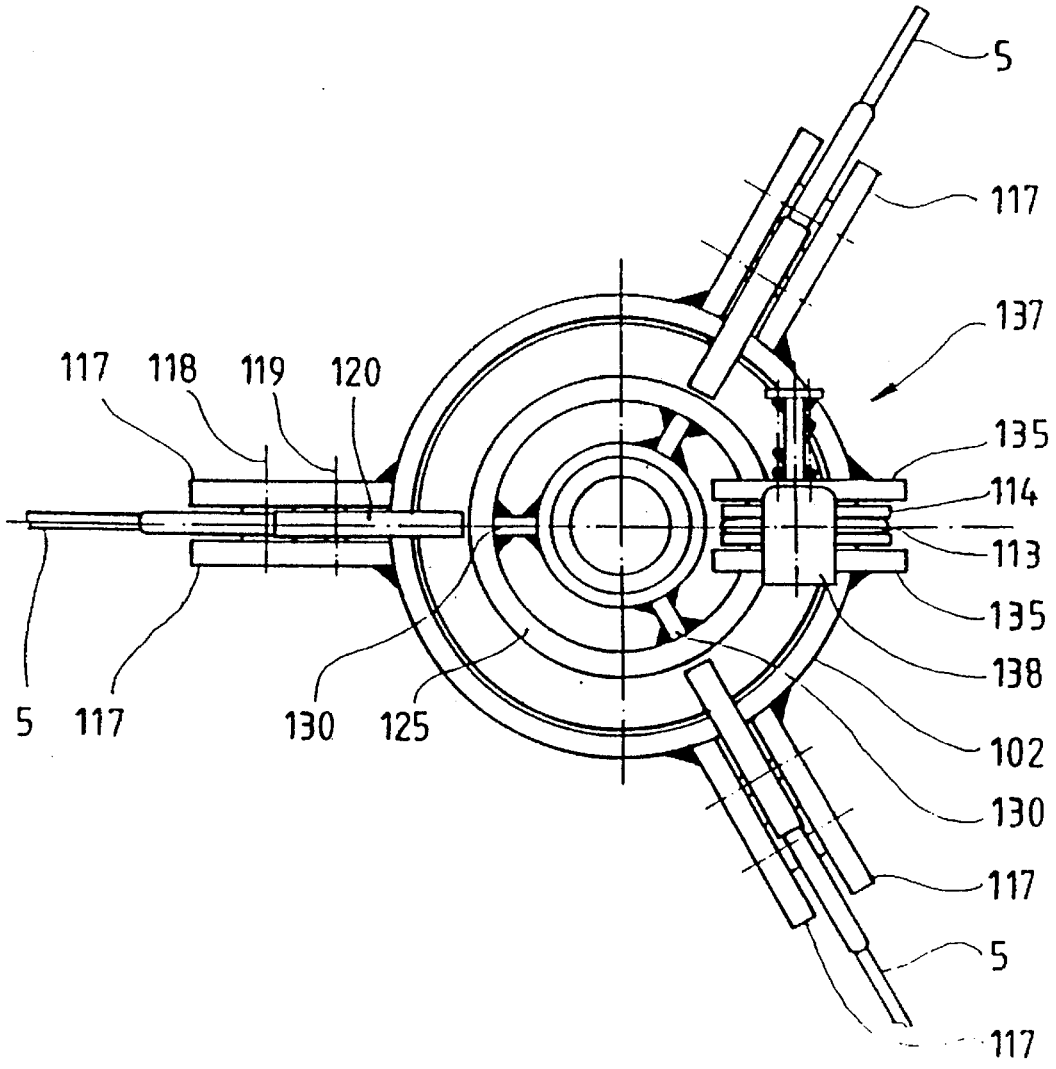
FIG. 32, a plan view of the illustration of FIG. 31 in the direction of the arrow XXXII.
Figure 33:
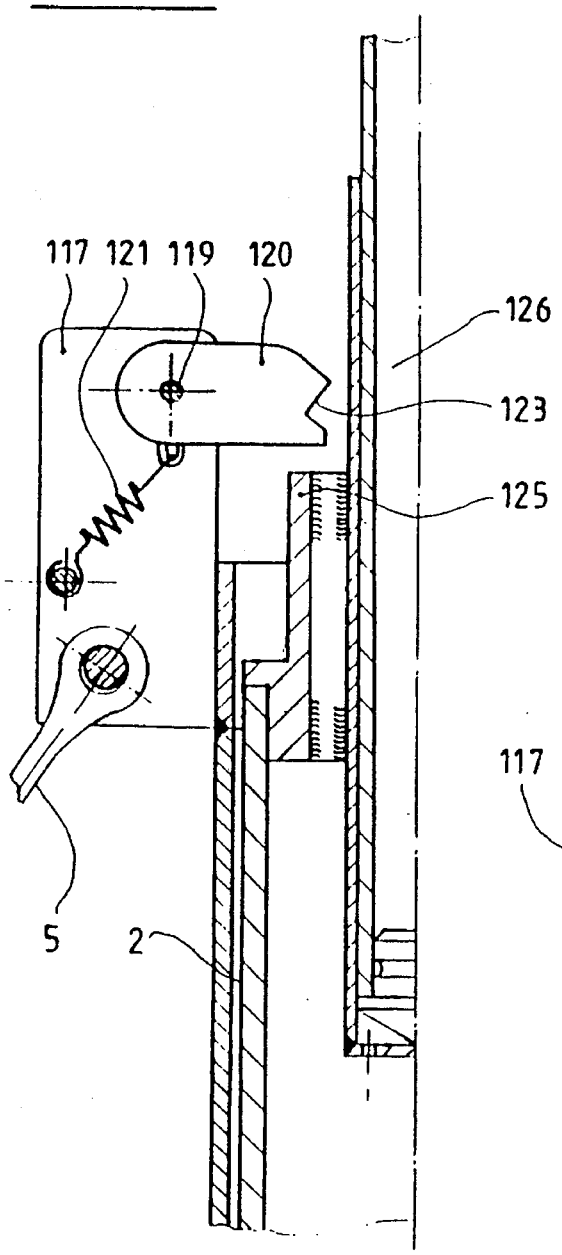
FIG. 33, the view of FIG. 31 in the unlatching position of the latches, half in section.
Figure 34:
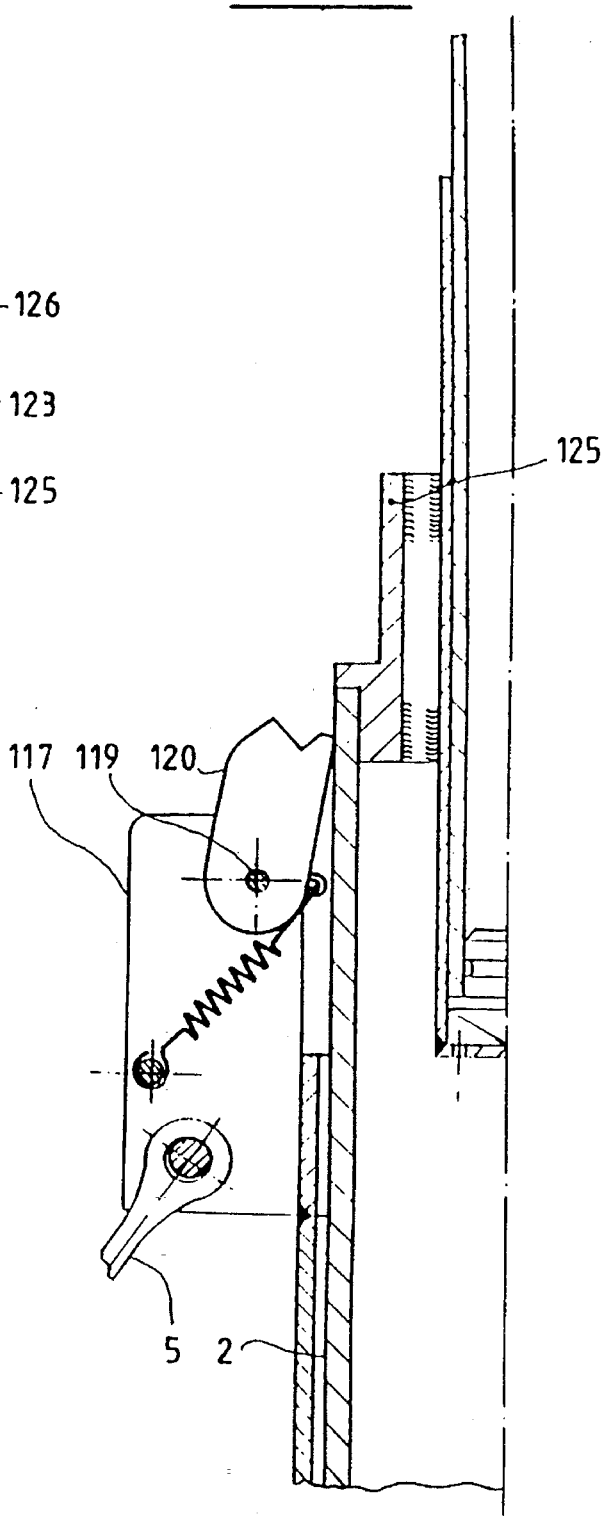
FIG. 34, the view of FIG. 31 in the lowered position of the latches, half in section.

A further alternative version of the publicity display provides, as shown in FIGS. 24 and 25, that the projectors 75 for illuminating the transparently embodied canvases 12 are secured from the inside to the tubular mast 2. For that purpose, an intermediate tube piece 93 surrounding the inner tube 42 is inserted in the region of the connection 43 between the middle individual section 38 and the upper individual section 39; on its outside, this intermediate tube piece carries three receiving flanges 94, offset by 120° from one another for the projectors 75.

In a further alternative version of the publicity display shown in FIGS. 26 to 34, the publicity supports 11 are disposed on the tubular mast 2 so as to be raisable and lowerable via a rope drive 99. To that end, the transversal tubes 4 that retain the publicity supports 11 are each joined via a joint 46 (FIG. 30) to a lower guide ring 100 of a cage 101 (FIG. 29), guided slidably on the tubular mast 2, and are retained in their horizontal position each by a cable 5 fixed to the free end of the transversal tube 4 and to an upper guide ring 102 of the cage 101; the cage 101 is movable to the desired position via the rope drive 99. The upper guide ring 102 is joined to the lower guide ring 100 by three connecting ribs 103 at an angle of 120° from one another.

The rope drive 99 includes a cable drum 104 (FIG. 27), disposed inside the lower region of the lower individual section 37 of the tubular mast 2 and actuatable by means of a self-locking crank 106 that can be engaged and disengaged via a suitable opening 105 in the individual section 37. The support of the cable drum 104 is effected in a rectangular tube 107 joined permanently at the bottom to the top of the support pan 31. On the outside, the rectangular tube is provided with one lower pair and one pair of opposed arc-shaped sections 108, which rest on the inside of the lower individual section 37 of the tubular mast 2. Via screw connections 109, the arc-shaped sections 108 are joined to the lower individual section 37 of the tubular mast 2. The rectangular tube 107 also carries an inverted-U-shaped bail 111 on its outside, via screw connections 110; the bail extends as far as the upper end of the lower individual section 37 of the tubular mast 2. Located in the crosspiece 112 of the bail 111 is a through opening for the cable 113 of the rope drive 99. The cable 113 beginning at the cable drum 104 extends through the interior of the tubular mast 2 as far as a deflection roller 114 (FIG. 31), mounted on the tip of the mast, and from there extends to a hook 115, disposed on the outside of the upper guide ring 102 of the cage 101, the cable 113 being secured to this hook. Inside the upper individual section 39, the cable 113 is guided in a guide rub 116 fixed on the inside of the individual section 39.

The upper guide ring 102 of the cage 101 has three pairs of straps 117 at an angle of 120° from one another. In the lower region, each pair of straps 117 has a transversely extending screw bolt 118, to which the cable 5 extending to the corresponding transversal tube 4 is secured. In the upper region, each pair of straps 117 receives a latch 120, supported so as to be rotationally movable on a transversely extending shaft 119; via a spring 121 joined with it, whose other end is fixed to a bolt 122 extending transversely in the middle region of the pair of straps 117, the latch is prestressed in the direction of the tubular mast 2. On its end protruding past the pair of straps 117, the latch 120 has a notch 123, which in the end position of the cage 101 rests on an encompassing shoulder 124 of a top piece 125 inserted into the face end of the upper individual section 39 of the tubular mast 2. To undo the support of the cage 101 on the top piece 125, which support is effective via the latches 120, the cage 101 should first be raised by means of the rope drive 99 far enough that the spring-loaded latches assume a horizontal unlatching position 126 (FIG. 33) above the top piece 125. In the ensuing downward motion of the cage 101 by means of the rope drive 99, the latches 120 change, resting on the tubular mast 2, first into an upwardly oriented lowering position 127 (FIG. 34), and then after executing a swiveling motion in suitable oblong slots 128 (FIG. 26) of the tubular mast 2 are brought into a downwardly oriented readiness position in contact with the tubular mast 2, from which position the cage 101 can be moved back into its locked end position.

The top piece 125 has a central opening 129 (FIG. 31) extending lengthwise. Located inside the opening 129 is a receiving tube 131, retained via three ribs 130 distributed over the circumference, for a flagpole 7 rotationally movably supported in this tube. The receiving tube 131, extending both above and below the top piece 125, is provided with a bottom plate 133 that has a water drain opening 132. The tip of a pointed cone 134 inserted into the underside of the flagpole 7 is supported on the bottom plate 133. In its upper region, the top piece 125 has a mount 137, comprising two opposed straps 135 with a transversely extending bolt 136, for the deflection roller 114. A securing lever 138 that is displaceable to the force of a spring is assigned to the top of the mount 137 in order to prevent the cable 113 from falling off the deflection roller 114.

The above description of the drawings has illustrated the details of the especially simple, practical-to-manipulate construction of the publicity display, which despite the ease of assembling it without a special tool and despite its compactness in transport—the entire publicity display can be collapsed to the size of a gym bag—likewise proves to be extremely reliable. Suitably, the individual construction components are of aluminum and the connecting elements are of special steel.

I claim:

1. A publicity display, comprising:

a central tubular mast;

a plurality of transversal tubes each having one end fixed to the central tubular mast and a free end projecting radially from the central tubular mast, a plurality of pairs of vertical support tubes, the tubes of each said pair of vertical support tubes having upper ends fixed to the free end of a respective one of the transversal tubes and lower ends, tensioning cables each having one end connected to the lower ends of the support tubes of a respective pair of the vertical support tubes and another end connected to a ground anchor, and a plurality of flexible canvases each for having an advertisement thereon and each being fixed on two of the vertical support tubes which are spaced apart from one another and fixed to adjacent transversal tubes to form a plurality of publicity supports each having a triangular plan view.

2. The publicity display of claim 1, wherein the tubular mast comprises a plurality of detachably joined-together, individual sections.

3. The publicity display of claim 1, wherein the mast has one end adjacent a ground surface, and said display further includes a base having three arms at an angle of 120° from one another attached to the one end of the mast.

4. The publicity display of claim 3, wherein the base includes a bottom plate and a top plate between which the arms of the base are pivotably supported.

5. The publicity display of claim 4, wherein the base includes screw bolts having ends protruding past the top plate and about which the arms of the base are pivotably supported, and the base further includes cardan joints each being fixed to a respective one of the protruding ends of the screw bolts between two nuts, and a support pan that receives the central tubular mast fixed to the cardan joints.

6. The publicity display of claim 5, wherein each cardan joint comprises a fork supported rotationally movably in the support pan, and a bearing eye supported rotationally movably in the fork, the fork of each cardan joint being received in the support pan longitudinally displaceably counter to a spring force.

7. The publicity display of claim 6, wherein the mast includes a lower section having a water drain that opens into the support pan.

8. The publicity display of claim 4, wherein each arm of the base has a flattened region with a through bore for receiving a ground nail.

9. The publicity display of claim 1, wherein the mast has an upper section to which the transversal tubes that carry the support tubes are secured.

10. The publicity display of claim 9, wherein the mast has an upper end and further includes a pipe clamp clamped to the mast, the transversal tubes each being joined to the pipe clamp by a joint, and a plurality of cables each being secured to the upper end of the mast and to a respective one of the free ends of the transversal tubes for retaining the transversal tubes in their horizontal position.

11. The publicity display of claim 10, wherein each transversal tube has an inside, and further including insert pieces each with a through bore for receiving a pivot pin, each insert piece being disposed on the inside of a respective one of the transversal tubes in a region of the joint.

12. The publicity display of claim 9, wherein the tubular mast has an upper end, and further including an attachment piece having a centrally disposed tube closed by a bottom plate for receiving a lower end of a flagpole.

13. The publicity display of claim 12, wherein the tubular mast has a face end and the attachment piece includes a tube section resting on the face end of the tubular mast and three pairs of straps which are at an angle of 120° from one another, the tube section being joined to the tube receiving the flagpole by the three pairs of straps, the pairs of straps and the tube having one end extending into the tubular mast, with contact of the pairs of straps with the inside of the tubular mast, and the pairs of straps and the tube having an opposite end extending beyond the tube section.

14. The publicity display of claim 13, wherein each pair of straps of the attachment piece has an upper region, and further including screw bolts each extending transversely through the upper region of a respective one of the pair of straps, an eye secured to each one of the screw bolts, each cable extending to the corresponding transversal tubes being secured to a respective one of the eyes.

15. The publicity display of claim 13, further including pairs of straps each being secured to a respective one of the free ends of the transversal tubes and screw bolts each securing one of the pairs of straps to a transversal tube and being joined to an eye that is secured to the cable extending to a corresponding pair of straps of the attachment piece.

16. The publicity display of claim 12, wherein the bottom plate of the tube includes a water drain opening.

17. The publicity display of claim 1, further including one protruding support for each pair of support tubes inserted into the free end of a respective transversal tube.

18. The publicity display of claim 17, wherein each protruding support is T-shaped and has two opposed arms which are angled toward the transversal tube in which the protruding support is inserted, each arm of the protruding support having an end piece bent upward at a right angle, and the support tubes each have a lateral opening for receiving a respective one of the bent end pieces for being suspended from the arms of the support.

19. The publicity display of claim 18, wherein each support includes a crosspiece joined to a threaded journal protruding at a right angle and extending through a bore in the respective transversal tube.

20. The publicity display of claim 1, wherein the lower end of each support tube has a bore, and further including one two-armed claw engaging the bores of each pair of support tubes and being joined to an eye secured to the associated tensioning cable.

21. The publicity display of claim 1, wherein each tensioning cable includes a tension spring.

22. The publicity display of claim 1, wherein the canvas of each publicity support has opposing lateral sides and a continuous eye provided at each lateral side, the support tubes of each publicity support each being disposed in a respective continuous eye and protruding at the ends thereof.

23. The publicity display of claim 22, and further including screws fixing the canvas on the support tubes.

24. The publicity display of claim 1, wherein at least one of the transversal tubes is adjustable in its length.

25. The publicity display of claim 24, further including a pipe clamp clamped to the mast, wherein each transversal tube is joined to the pipe clamp by a joint, the joint associated with the at least one adjustable-length transversal tube includes a bearing bush and a threaded rod secured to the bearing bush and protruding into the one end of the transversal tube through a guide bush, and further including a compression spring surrounding the threaded rod between a knurled nut which is adjustable on the threaded rod and the guide bush.

26. The publicity display of claim 1, further comprising projectors disposed on the transversal tubes for illuminating the canvas of the respective publicity supports.

* * * * *